United States Patent [19]

Britton et al.

[11] 4,265,310

[45] May 5, 1981

[54] FRACTURE PREHEAT OIL RECOVERY PROCESS

[75] Inventors: Michael W. Britton; William L. Martin; Jack D. McDaniel; Harry A. Wahl, all of Ponca City, Okla.

[73] Assignee: Continental Oil Company, Ponca City, Okla.

[21] Appl. No.: 948,359

[22] Filed: Oct. 3, 1978

[51] Int. Cl.[3] ..... E21B 43/17; E21B 43/24; E21B 43/247

[52] U.S. Cl. ..... 166/259; 166/263; 166/271; 166/272

[58] Field of Search ..... 166/263, 259, 271, 272, 166/273, 274

[56] References Cited

U.S. PATENT DOCUMENTS

| | | | |
|---|---|---|---|
| 2,148,717 | 2/1939 | Whitney | 166/272 |
| 2,969,226 | 1/1961 | Huntington | 166/271 |
| 3,129,758 | 4/1964 | Closmann | 166/263 |
| 3,221,813 | 12/1965 | Closmann et al. | 166/271 |
| 3,280,909 | 10/1966 | Closmann et al. | 166/271 X |
| 3,342,258 | 9/1967 | Prats | 166/259 |
| 3,379,250 | 4/1968 | Matthews | 166/271 |
| 3,396,791 | 8/1968 | Van Meurs et al. | 166/272 |
| 3,411,575 | 11/1968 | Connally, Jr. | 166/259 |
| 3,455,383 | 7/1969 | Prats et al. | 166/272 X |
| 3,481,399 | 12/1969 | Hujsak | 166/261 X |
| 3,513,914 | 5/1970 | Vogel | 166/271 |
| 3,613,785 | 10/1971 | Closmann et al. | 166/271 |
| 3,908,762 | 9/1975 | Redford | 166/263 |
| 3,997,004 | 12/1976 | Wu | 166/272 X |
| 4,068,717 | 1/1978 | Needham | 166/272 |

OTHER PUBLICATIONS

Doscher et al., "Steam Drive Successful in Canada's Oil Sands," *Petroleum Engineer,* Jan. 1964, pp. 71–78.

Satter, SPE Paper No. 1950, Oct. 1967, "A Prediction Method for Conduction Heating of Reservoirs by Steam Injection".

Baker, "Heat Wave Propagation and Losses in Thermal Oil Recovery Processes," Proceeding of the 7th World Petroleum Congress, 1967, vol. 3, pp. 459–470.

Thurber, "How Shell Attempted to Unlock Utah Tar Sands," *Petroleum Engineer,* Nov. 1977, pp. 31–42.

*Primary Examiner*—Stephen J. Novosad
*Assistant Examiner*—George A. Suchfield
*Attorney, Agent, or Firm*—A. Joe Reinert

[57] ABSTRACT

A zone of increased heat and enhanced fluid mobility is established between an injection well and a production well vertically traversing a heavy oil (bitumen, tar) reservoir by (a) first horizontally hydraulically fracturing between the wells, and (b) then injecting hot water and/or steam into the injection well at a very high rate, at a sufficient pressure, and for a sufficient time (holding sufficient back pressure on the production well if needed) to float the formation along the fracture system between the wells, to effect channel flow of fluids through the floated fracture system (with production from the production well), and to effect effective and uniform heating of substantial reservoir volume perpendicular to the channel flow. Thereupon, other thermal methods such as matrix flow steam flooding can be employed to recover additional oil.

32 Claims, 11 Drawing Figures

FRACTURE PREHEAT OIL RECOVERY PROCESS

BACKGROUND OF THE INVENTION

1. Field of the Invention

The invention relates to recovery of heavy oil. In one aspect, the invention relates to establishment of a heated permeability zone in an unconsolidated heavy oil sand reservoir suitable for recovery of the heavy oil by heated fluid displacement. The invention has particular utility in recovery of heavy oils or tars from Athabasca class deposits, although it is also useful for recovery of oils having higher API gravity, particularly from relatively thin reservoirs or shallow reservoirs having relatively low permeability.

2. Brief Description of the Prior Art

The following comprises a prior art statement in accord with the guidance and requirements of 37 CFR 1.5, 1.97, and 1.98.

There are many subterranean heavy oil containing formations throughout the world from which the oil cannot be recovered by conventional means because of its high viscosity. The so-called tar sands or bitumen sand deposits are an extreme example of such viscous heavy oil containing formations. A tremendously large energy resource [some 2,100-billion barrels ($334\times10^9m^3$)—almost as much as the world's known reserves of lighter oil] is available in such deposits, provided that technology is developed to recover such heavy oil at favorable economics.

One of the larger of the tar sands deposits is located in the northeastern part of the province of Alberta, Canada, and is estimated to contain in excess of 700 billion barrels ($112\times10^9m^3$) of heavy oil. The tar belts of Venezuela are reputed to contain even larger quantities than the rest of the world combined. Lesser deposits are located in Europe and Asia. In the U.S., extensive tar sands deposits exist in California, Utah, Texas, and elsewhere. One resource of particular interest includes tar sand deposits in Maverick and Zavala Counties, of South Texas, which are estimated to contain 10 billion barrels ($1.60\times10^9m^3$) or more of very heavy oil or tar having an API gravity in the range of $-2$ to $+2$. In certain aspects, the Texas tar sands are even more difficult to recover heavy oil from than the Athabasca tar sands. The tar in this resource is essentially a solid at reservoir temperature. An exemplary San Miguel sand of the resource averages about 50 feet (15.24 m) in thickness with a permeability of about 500 to 1000 millidarcies [$0.49(\mu m)^2-0.99(\mu m)^2$] and about 30 percent porosity. Initial oil saturation is about 55 percent and depth is about 1500 feet (457 m).

Such heavy oil deposits or tar sands deposits of the Athabasca class or type, in which the invention is most useful, can be generally described with reference to the Athabasca deposits as an example. The Athabasca heavy oil or tar sands are described as sand saturated with a highly viscous heavy crude oil not recoverable in its natural state through a well by ordinary petroleum recovery methods. The oil is highly bituminous in character with viscosities up to millions of centipoise at formation temperature and pressure. The API gravity of the heavy oil ranges from about 10° to about 6° in the Athabasca region and on down to negative numbers in other deposits such as the Maverick County, Texas, deposits. At higher temperatures, such as temperatures of above about 200° F. (93° C.), this heavy oil becomes mobile, but at such temperatures the heavy oil deposits are incompetent or unconsolidated. The oil content of the deposit generally is about 10 to 12 percent by weight, although sands with lesser or greater amounts of oil content are not unusual. Additionally, the sands generally contain small amounts of water, generally about 3 to about 10 percent by weight. The deposits are about 35 percent pore space by volume or 83 percent sand by weight. The sand is generally a fine-grain quartz material. One of the striking differences between such deposits and more conventional petroleum reservoirs is the absence of a consolidated matrix. While the sand grains are in grain-to-grain contact, they are not cemented together.

Excellent descriptive matter relating to tar sands is found in "The Oil Sands of Canada—Venezuela, 1977", CIM Special Volume 17, The Canadian Institute of Mining and Metallurgy (1977), which represents the collective proceedings of the Canada-Venezuela Symposium, held in Edmonton, Alberta, Canada, May 30th to June 4th, 1977.

In contrast to the situation relating to the Athabasca class deposits, a variety of processes are available to the industry for the recovery of heavy oil from many consolidated reservoirs having appreciable fluid permeability, provided that such reservoirs are thick enough for economic recovery.

For example, forward combustion and water modified forward combustion or fire flooding processes are being successfully employed in a number of such reservoirs. Detailed information relating to a project involving such processes is available by way of the U.S. Department of Energy under Contract EY-76-C-03-1189, wherein Cities Service Company as contractor is conducting improved oil recovery by in situ combustion in the Bellevue Field in Louisiana. Considerable other information on such processes is published and available from a number of sources.

A second type of thermal recovery processes include the steam and hot water injection processes.

With the so-called huff-and-puff process, steam is injected into a producing well, the well is allowed to soak for a while, and then fluids including mobilized oil are produced. A variety of successful huff-and-puff projects are in operation and considerable data are published.

Essentially two separate types of hot water and steam injection processes involving fluid displacement are in use.

The first type is a drive or matrix flow process in which hot water or steam, or some intermediate mixture is continuously injected into a reservoir at relatively low rates and pressures to heat and displace oil in a modified water flooding manner. This technique works satisfactorily if the oil at natural reservoir conditions is sufficiently mobile to be moved at practical rates by hot fluid injection without vertical parting of the reservoir or uncontrolled viscous fingering and tonguing. Earlier successful uses of this process have been employed at Kern River, California, the Schoonebeek Field in the Netherlands, and Tia Juana Field in Venezuela. Many more recent successful uses of this method have also been employed.

A second type of displacement process, which can be referred to as a conduction heating steam flood, involves conduction heating of a reservoir from hot fluid passing through a highly permeable zone, such as a horizontal fracture, a gas cap at the top of the reservoir, or a relatively thin section of permeability within or adjacent to the main pay zone such as a water zone at the bottom of the deposit. The reservoir section adjacent to the highly permeable zone is heated by vertical conduction of heat from steam or hot water in the channel and also by condensation of steam or transfer by hot water which may have leaked from the channel. If a permeability channel can be opened and kept opened until flow of heated heavy oil is established, this type process has application to heavy oil reservoirs in which the reservoir fluids are essentially immobile at reservoir temperature.

In SPE Paper No. 1950 by Abdus Satter (prepared for the 42nd Annual Fall Meeting of the Society of Petroleum Engineers of AIME held in Houston, Texas, Oct. 1–4, 1967); Doscher et al (*Petroleum Engineer,* January (1964) pp. 71–78) are cited as reporting that Shell Oil Company carried out the first known conduction heating operation in the Athabasca tar sands. Therein it is reported that a horizontal fracture was propagated between the injection and production wells in the Athabasca sand followed by steam and aqueous solution injection to produce at least some oil-in-water emulsions to demonstrate the theoretical viability of the approach.

Since then, a number of approaches involving fracturing followed by conduction heating steam flooding have been proposed.

An unsuccessful attempt to unlock Utah tar sands is reported by Thurber, *Petroleum Engineer,* November (1977) pp. 31–42.

However, it has been and is recognized in the art that conduction heating steam flooding requires the establishment of a communication path between an injection and a production well through which the fluids may be passed. As is pointed out by Doscher et al in U.S. Pat. No. 3,221,813 (which may disclose the closest approach to our invention), conventional thermal drive processes do not generally prove effective in recovering oils from heavy oil deposits of the Athabasca type. Such heavy oil sands at the natural temperatures of the deposits are not sufficiently permeable to allow the steam or other hot fluids to pass through the deposits to effectively lower the viscosity of the oil therein. Neither has use of conventional sand packed fracturing proved sufficient to make thermal drives in Athabasca class heavy oil deposits practical. Such fractures tend to close as soon as the pressure utilized to create them is relieved. Upon this occurrence, the unheated tar sand reverts to its impermeable state and is not subject to production with conventional thermal drive processes. In a competent formation, the closing of such a fracture can be avoided by introducing propping agents such as granular materials into the fracture to hold it open. This method, however, is ineffective in respect to an incompetent heavy oil-bearing formation such as an Athabasca type tar sand. Such tar sands are relatively soft and subject to plastic flow. Thus, even if a sand packed fracture is produced, as soon as the walls of the fracture become heated, the incompetent formation slumps between the grains of the propping agent and permeability is lost. Also, any bitumen heated by the injected fluid will flow in an unheated or less than adequately heated fracture zone for only a brief period before it loses heat and becomes so viscous that it is essentially immobile, resulting in the plugging of the channel. Such problems relating to establishing and maintaining fluid mobility between the injection and production wells, particularly near the production well, are also of critical importance with lighter heavy oils, particularly those that have considerable viscosity at or near reservoir temperature.

In addition to the approach involving attempted formation of aqueous emulsions with aqueous caustic solutions as proposed in *Petroleum Engineer,* January (1964) pp. 71–78, various other processes have been proposed as are disclosed in the following references: U.S. Pat. Nos. 4,068,716; 3,881,551; 3,342,258; 2,876,838; 2,813,583; 4,068,717; 3,613,785; 3,346,048; 3,810,510.

The closest approach of the prior art to their invention with which the inventors are familiar is exemplified by the following five patents. The problem of viscous tar plugging of the communication channels between the wells in Athabasca type heavy oil sands at the cooler downstream end of the channels is recognized by this prior art and proposals are made to deal with it in a number of ways which are different from the process of the invention.

Three patents assigned to Shell Oil Company, namely U.S. Pat. Nos. 3,221,813, 3,379,250, and 3,396,791, appear to be the most relevant. U.S. Pat. No. 3,221,813 discloses fracturing between an injection and a production well in a tar sand formation, injecting steam at floating pressures into the injection well, and periodically removing viscous tar plugs in the channel by circulating a tar entraining liquid such as a petroleum emulsifier or a petroleum solvent. U.S. Pat. No. 3,379,250 discloses a process wherein a hydraulic fracture is established between a production well and an injection well in a tar sand formation and a heated channel is formed therebetween by circulating water through the fracture while raising its temperature gradually such that no more than 1° F. temperature differential per foot occurs. U.S. Pat. No. 3,396,791 discloses a process wherein a hydraulic fracture is established between an injection well and a production well in a tar sand formation, water of increasing temperatures is circulated through the fracture until the viscosity of the tar is less than about 50 cp. and then steam is passed through the formation from the injection well to the production well.

U.S. Pat. No. 3,908,762 discloses establishing a hydraulic fracture between an injection well and a production well traversing a tar sand formation, and then establishing a heated permeability zone between the wells by injecting steam plus a noncondensable gas at a pressure not exceeding a value in psi numerically equal to the overburden thickness in feet. Including the noncondensable gas (such as $CO_2$, methane, nitrogen, or air) along with the steam injected is purported to alleviate the problem of viscous tar plugging the channel at the cooler production well end during the steam injection step.

U.S. Pat. No. 3,411,571 discloses horizontally fracturing and propping between a production well and an injection well traversing a tar sand formation, passing steam from the injection well to the production well, then steam from the production well to the injection well, and then fire flooding from the injection to the production well. The process disclosed therein does not appear to address the problem of plugging of the fracture when tar mobilized by the steam flood flows into cooler regions, and does not appear to be suitable for very heavy Athabasca type heavy oil sand deposits.

Though the processes disclosed by the prior art have considerable merit, and in fact are quite useful for recovering heavy oil from reservoirs which are consolidated and wherein the heavy oil is substantially less viscous than Athabasca type heavy oil, commercially successful recovery of heavy oil from an Athabasca type deposit, that is wherein the heavy oil is very viscous at reservoir temperature and less than 10 API gravity, wherein the reservoir is incompetent, and wherein the reservoir is substantially impermeable at its natural temperature, has not yet been demonstrated. The closest approach to commercially recovering heavy oil from such reservoirs involves a special case wherein a water zone through which fluid communication may be established lies adjacent to and below the heavy oil deposit. The process disclosed and claimed herein provides a breakthrough for commercial oil recovery from such deposits.

The processes of the prior art are also less than adequate for economic recovery of higher API gravity heavy oil from deposits which are relatively thin, of shallow depth, or of low permeability, particularly with an economically feasible distance between wells. In such reservoirs, an uneconomically large amount of steam is wasted by the prior methods in heating underburden and overburden in order to heat and recover a given amount of heavy oil.

Even in reservoirs subject to feasible recovery by thermal processes presently available, considerable improvement is needed in thermal efficiency. Thermal efficiency "$TE_{RH}$" is discussed by P. E. Baker, "Heat Wave Propagation and Losses in Thermal Oil Recovery Processes", Proceeding of the 7th World Petroleum Congress—1967, Volume 3, p. 459–70. This publication, which is herewith incorporated by reference, defines $TE_{RH}$ (Thermal efficiency for reservoir heating) by:

$$TE_{RH} = \frac{1}{X^2}\left(e^{X^2}\, erfc\, X + \frac{2X}{\sqrt{\pi}} - 1\right)$$

$$\text{wherein } X = \frac{2K_{ob}}{h(\rho C)_r}\sqrt{\frac{(\rho C)_{ob}\, t^{1/2}}{K_{ob}}}\ ;$$

wherein $K_{ob}$ is the thermal conductivity of the overburden, a determined value normally expressed in Btu/hr-ft-°F. (or alternate metric terms);

wherein erfc is the complimentary error function obtainable from standard math tables of tabulated values;

wherein h is the measured value of thickness of the heated reservoir body, normally expressed in feet (or alternate metric terms);

wherein $\rho C$ is the measured heat capacity of the material in point, normally expressed in Btu/ft$^3$-°F. (or alternate metric terms);

wherein $\rho$ is the determined (measured) density of the material, normally expressed in lbs/ft$^3$ (or alternate metric terms);

wherein C is the determined specific heat capacity of the material, normally expressed in Btu/lb.-°F. (or alternate metric terms);

wherein $(\rho C)_{ob}$ is the heat capacity of the overburden;

wherein $(\rho C)_r$ is the heat capacity of the reservoir; and wherein t is time, usually expressed in days or hours.

In essence, $TE_{RH}$ (thermal efficiency for reservoir heating) is the fraction of heat at a point in time that is imparted into and is maintained in the reservoir relative to the total heat injected. Typically, $TE_{RH}$ ranges from about 20 to 40 percent 0.2 to 0.4 for prior art processes. None are known of having a value for $TE_{RH}$ over about 40 percent. During the high rate injection of our process, $TE_{RH}$ is over 40 percent, typically is in the range of 70 to 90 percent, and may approach 100 percent.

As is well known to those skilled in this art, thermal efficiency is a key to economics and economics is the key to feasibility. One simply cannot spend more on energy or otherwise to recover heavy oil than the heavy oil is worth.

OBJECTS OF THE INVENTION

An object of the invention is to provide a process for the commercial recovery of heavy oil, particularly heavy oil from a tar sand reservoir, that is, a process characterized by high thermal efficiency, efficient oil displacement, and economic feasibility resulting from efficient reservoir heating.

Another object of the invention is to provide a process for establishment of a zone of increased heat and enhanced fluid mobility traversing a heavy oil deposit between an injection well and a production well through which heavy oil can be recovered, as by drive or matrix flow steam flooding.

SUMMARY OF THE INVENTION

A zone of increased heat and fluid mobility is established between an injection well and a production well vertically penetrating a heavy oil reservoir by sequentially:

(a) hydraulically fracturing between the wells, (b) injecting hot aqueous fluid into the injection well, and (c) producing fluids from the production well;

in an improved manner characterized by injection of the hot aqueous fluid at a sufficiently high rate, at a sufficient pressure, and for a sufficient time to maintain parting of the formation along the fracture system between the wells, to effect channel flow of liquids through the parted fracture system, and to effect conduction heating of substantial reservoir volume perpendicular to the direction of channel flow.

A zone of increased heat and fluid mobility is established between an injection well and a production well vertically penetrating a heavy oil reservoir by:

(a) hydraulically fracturing between the wells (b) injecting steam into the injection well, and (c) producing fluids from the production well;

in an improved manner characterized by injection of steam into the fracture system between the wells at a sufficient rate, at a sufficient pressure, and for a sufficient time to establish a thermal efficiency for reservoir heating ($TE_{RH}$) of over 40 percent, and according to preferred modes, of over 70 percent.

According to one aspect, steam is injected at a rate "$Q_s$" expressed in barrels of water per day which is at least equal to:

$$1812\ A/h \exp\left[0.02739 \times TE_{RH}\right];$$

wherein A is the horizontal area to be heated between the wells expressed in acres, wherein h is the thickness of the reservoir to be substantially heated in feet, and wherein $TE_{RH}$ is greater than 40 percent, more preferably 70 percent or higher. In alternate metric terms:

$$Q_s \geqq 0.02174\ A/h \exp\left[0.02739 \times TE_{RH}\right]$$

$$TE_{RH} > 40\%,\ \text{preferably} \geqq 70\%;$$

wherein: $Q_s$ is expressed in $m^3$ of $H_2O$ per day, A is expressed in $m^2$, and h is expressed in m.

If a heated aqueous fluid other than steam (such as hot water or a mixture of hot water and steam) is injected, an analogous fluid injection rate for the aqueous fluid, i.e., "$Q_f$", can readily be determined in accord with the following relationship:

$$Q_f = \frac{Q_s \times 1000}{SG_f \overline{H}_f}$$

wherein the subscript "f" denotes the fluid to be injected, wherein $\overline{H}_f$ is the bottomhole enthalpy of the fluid expressed in Btu per pound, wherein $SG_f$ is the ambient temperature specific gravity of the fluid, and wherein a barrel of steam is defined to have a bottomhole enthalpy of 1000 Btu per pound 2323 joule/gram or 350,000 Btu per barrel ($5.86\times10^7$ J/$m^3$). Thus, since $Q_H=Q_s\times350\times\overline{H}_s$, and $\overline{H}_s=1000$, in terms of an equivalent heat injection rate and where $Q_H$ is the daily rate of heat injection, the preceeding equations for the daily rate of steam become: $Q_H=6.342\times10^8$ A/h exp $[0.02739\times TE_{RH}]$ expressed in American units; or $Q_H=5.04\times10^7$ A/h exp $[0.02739\times TE_{RH}]$ expressed in metric terms such that $Q_H$ is expressed in J/day.

According to another aspect of the invention, the zone of heated heavy oil mobility horizontally traversing a heavy oil reservoir is subsequently substantially swept with a drive front of steam, combustion, water modified combustion, oxygen enhanced steam, caustic enhanced hot water, or hot water.

According to another aspect of the invention, hot fluids produced at the production wells are passed through a heat exchanger to heat water employed to generate steam.

According to another aspect of the invention, a thinning agent for the produced heavy oil, such as a light hydrocarbon solvent, or water plus an emulsifying agent, is injected to the production horizon of the production well and there admixed with the produced heavy oil to prevent plugging of the production well by congealing of the heavy oil.

According to another aspect of the invention, the zone of heated heavy oil mobility horizontally traversing the heavy oil deposit is established in a tar sand formation having an API gravity of less than 10 which is substantially impermeable to fluids at reservoir temperature by the following sequential steps:

(a) penetrating the tar sand formation with an injection wellbore and a production wellbore horizontally separated from each other;
(b) hydraulically and/or explosively fracturing from the production well;
(c) injecting steam into the production well to part the fracture zone and impart heat to it;
(d) hydraulically fracturing from the injection well;
(e) injecting hot water and/or steam into the injection well at a sufficient rate and pressure to part the formation along the fracture system between the wells and thus form a heated channel of mobilizable tar in the formation in proximity to the fracture system between the wells; and
(f) passing hot water and/or steam into the injection well and fluids through the heated permeable channel between the wells to effect conduction heating steam flooding therebetween with tar recovery from the production well.

According to yet another aspect, the tar sand is subsequently swept of tar in the heated zone between the wells by a predominantly matrix flow drive front of steam, combustion, water modified combustion, oxygen enhanced steam, caustic enhanced hot water, or hot water; presently, preferably by a drive front of steam by matrix flow.

According to yet another aspect, a plurality of injection wells and a plurality of production wells are employed in a pattern wherein at least one production well and preferably at least two production wells are employed for each injection well.

DESCRIPTION OF THE DRAWINGS

FIGS. 1 through 5 illustrate stages of one presently particularly preferred embodiment of the invention wherein tar sand is recovered from a subterranean tar sand containing formation as is noted in the "Brief Description of Drawings" section. Similar numbers are employed to refer to similar features in these FIGS. 1 through 5.

Figure 1:
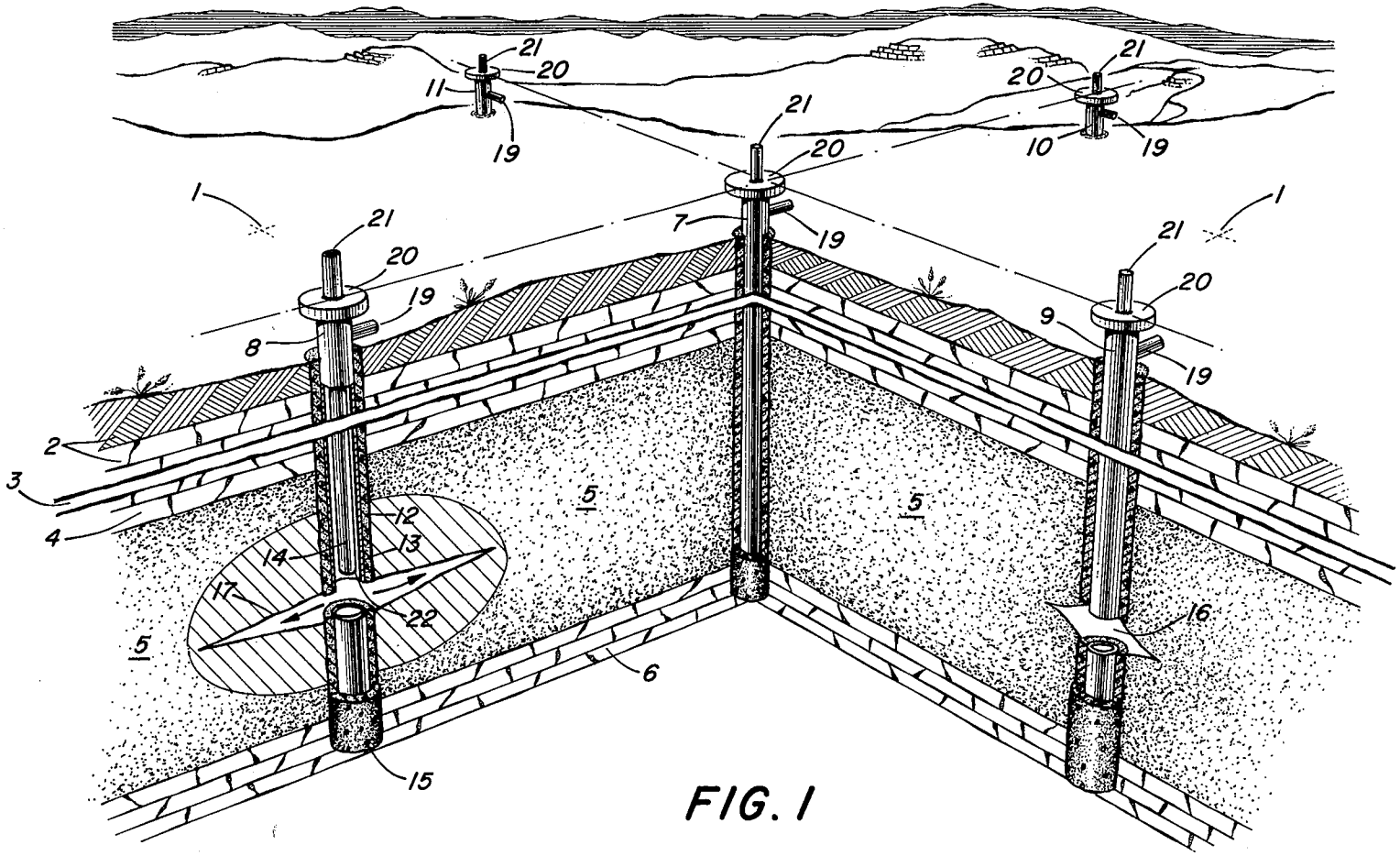
FIG. 1 illustrates in semischematic fashion, a cutaway section of a tar sand reservoir in which a presently preferred mode of the invention is under way, employing an inverted five-spot configuration at a point in time following hydraulic fracturing and steam stimulation of the left foreground well and notching in preparation for hydraulic fracturing of the right foreground well of the five-spot.

Thus, referring to FIG. 1, terrain 1 comprising overburden 2 shown with break line 3 and overburden 4 lie over the tar sand formation 5 which is underlain by stratum 6.

The overburden and tar sand formation 5 are vertically traversed by an inverted five-spot pattern of wellbores comprised of center injector well 7 and outlying production wells 8, 9, 10, and 11. Each well traversing the tar sand formation comprises casing 13 cemented to the formation by cement 12 and having tubing 14 communicating to external facilities via outlet 21 through wellhead 20, and forming annulus 22 between the tubing and the well casing which communicates to external facilities through outlet 19. The wells are set through the tar sand formation and cememted to the underlying strata by cement 15.

According to a presently preferred mode now described, each of the outlying production wells is first notched by rotating a hydraulic cutting tool to form notch 16 and then hydraulically fractured to form horizontal hydraulic fracture 17. Well 9 is shown at the completion of notching preparatory to hydraulic fracturing in FIG. 1. Fracturing can be accomplished either by injecting an aqueous fluid through outlet 21 and tubing 14 or through outlet 19 and through annulus 22 into the notch previously formed. Well 8 is shown subsequent to injecting steam at floating pressure, that is, at a pressure sufficient to maintain parting of the hydraulic fracture. The heated zone 18 shown near well 8 shows the extent of substantial heating of the tar sand formation by the steam treatment step. At the point in time shown on FIG. 1, well 8 has been fractured and steam treated and shut in for a soak period. Well 9 has just been notched preparatory to hydraulic fracturing. Wells 10 and 11 are yet to be treated in sequence.

Figure 2:
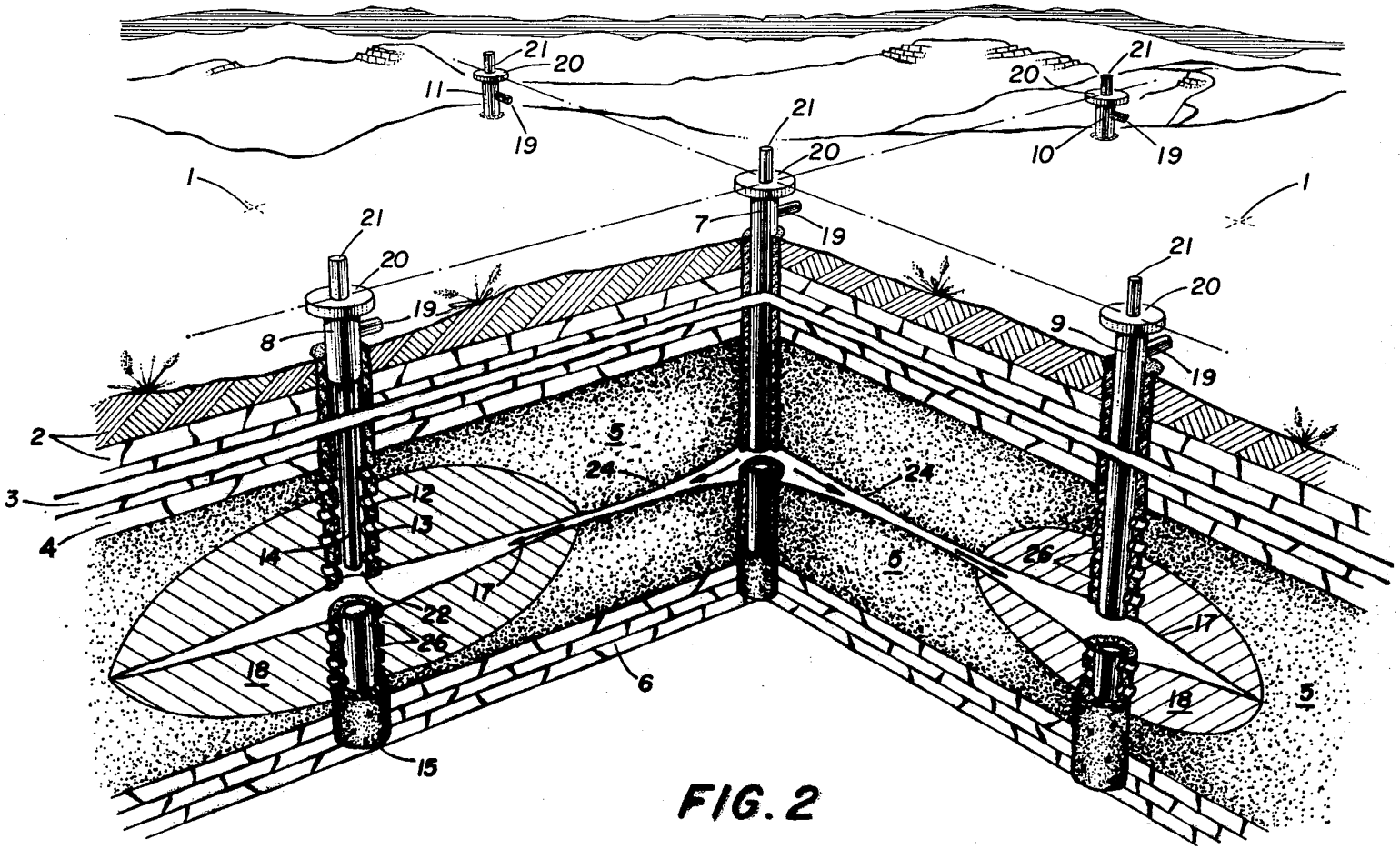
FIG. 2 illustrates a semischematic cutaway cross section illustrating the process at a period in time following fracturing and steam stimulation of the outlying wells of the inverted five-spot and establishment of fluid communication by fracturing from the center injection well to establish communication with the heated zones near outlying production wells.

FIG. 2 illustrates the process embodiment at a point in time following treatment of the outlying production wells by hydraulic fracturing and steam followed by perforation. Thereupon, the center injection well is notched and then hydraulically fractured into communication with the outlying production wells via horizontal fracture 24. The outlying production wells are back pressured as needed to distribute the hydraulic horizontal fracture over the pattern covered by the inverted five-spot.

Thereupon, steam is immediately injected either through outlet 21 or outlet 19 or both of the injection well 7 and through the fracture system at a sufficiently high rate, at a sufficient pressure, and for a sufficient time to float the formation along at least a major part of the fracture system between the wells formed by hydraulically fracturing the center injection well and the outlying production wells, to effect predominantly channel flow of liquids through the floated fracture formation and to effect conduction heating of substantial reservoir volume vertically perpendicular to the channel flow. Perforations 26 are made in the casing and cement of the production wells, as with a conventional perforation gun or jetting tool. Fluids are produced from the production wells. Back pressure is held on the production wells as needed to distribute the flow evenly over the pattern as fluids are produced from the corner production wells.

Figure 3:
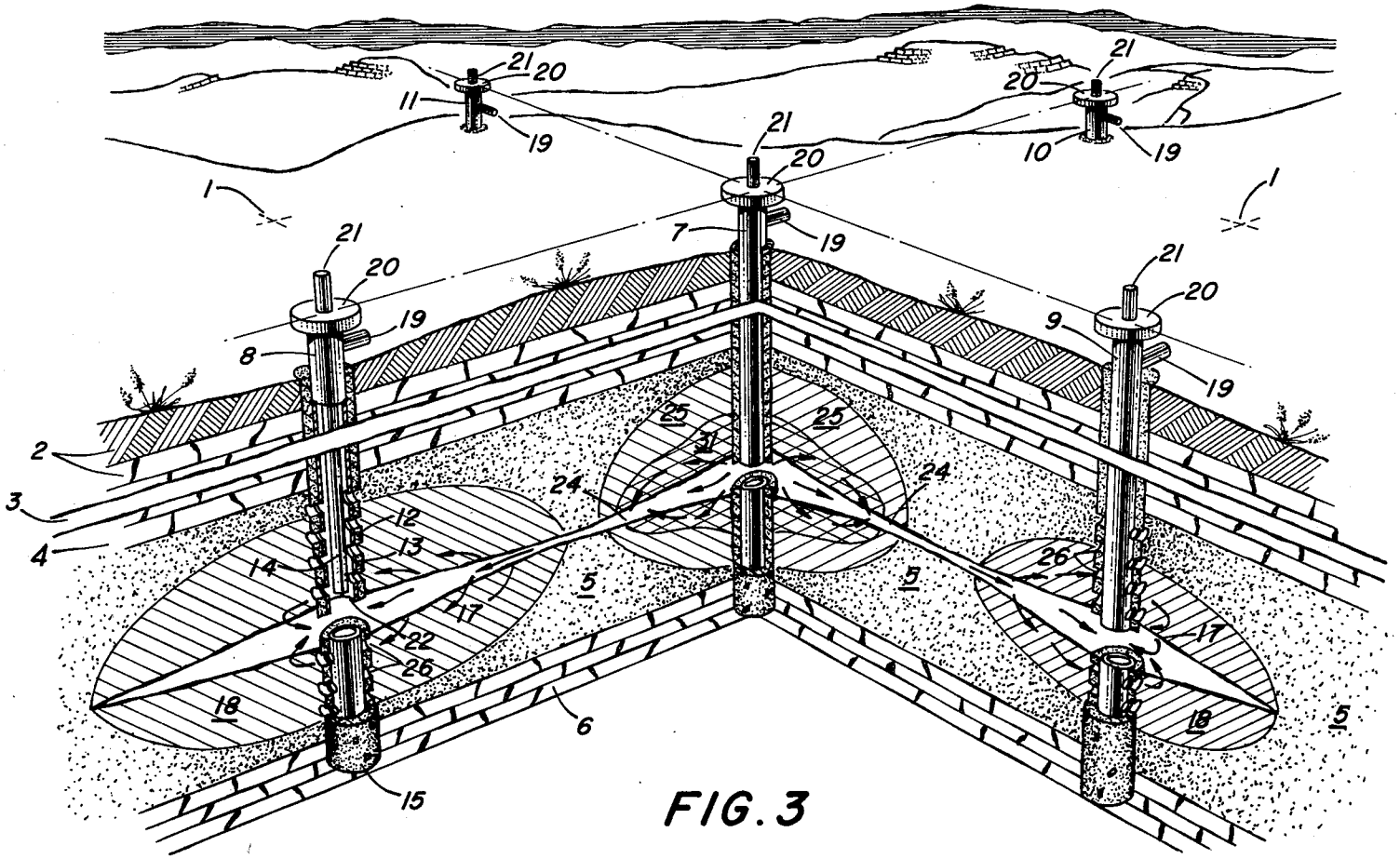
FIG. 3 illustrates a semischematic cutaway cross section of the inverted five-spot at a point in time in the process after conduction heating steam flooding is initiated through the fracture system at a pressure sufficient to float the formation.

FIG. 3 illustrates the process embodiment at a point in time at high rates and pressures is injected through injection well 7. Zone 25 is conduction heated by steam passing from injection well 7 through the floated horizontal fracture system 17 and 24 toward production wells 8, 9, 10, and 11. Some fluid flow is beginning to occur in this zone 25 as well as in more intensely heated zone 31 and in previously heated zones 18, as shown by the flow arrows. At this point, the fracture system 24 and 17 is filled with steam and some mobilized tar and condensate out to the point indicated by the leading edge of zone 31. From that point on through the fracture system channel, the make-up of the moving fluids gradiates to higher proportions of produced tar and condensate as the steam gives up its heat and condenses. Though there is some matrix flow and interchange of fluids between the fracture channel and the adjacent heated matrix, fluid flow is predominantly through the floated fracture channel, as illustrated.

Figure 4:
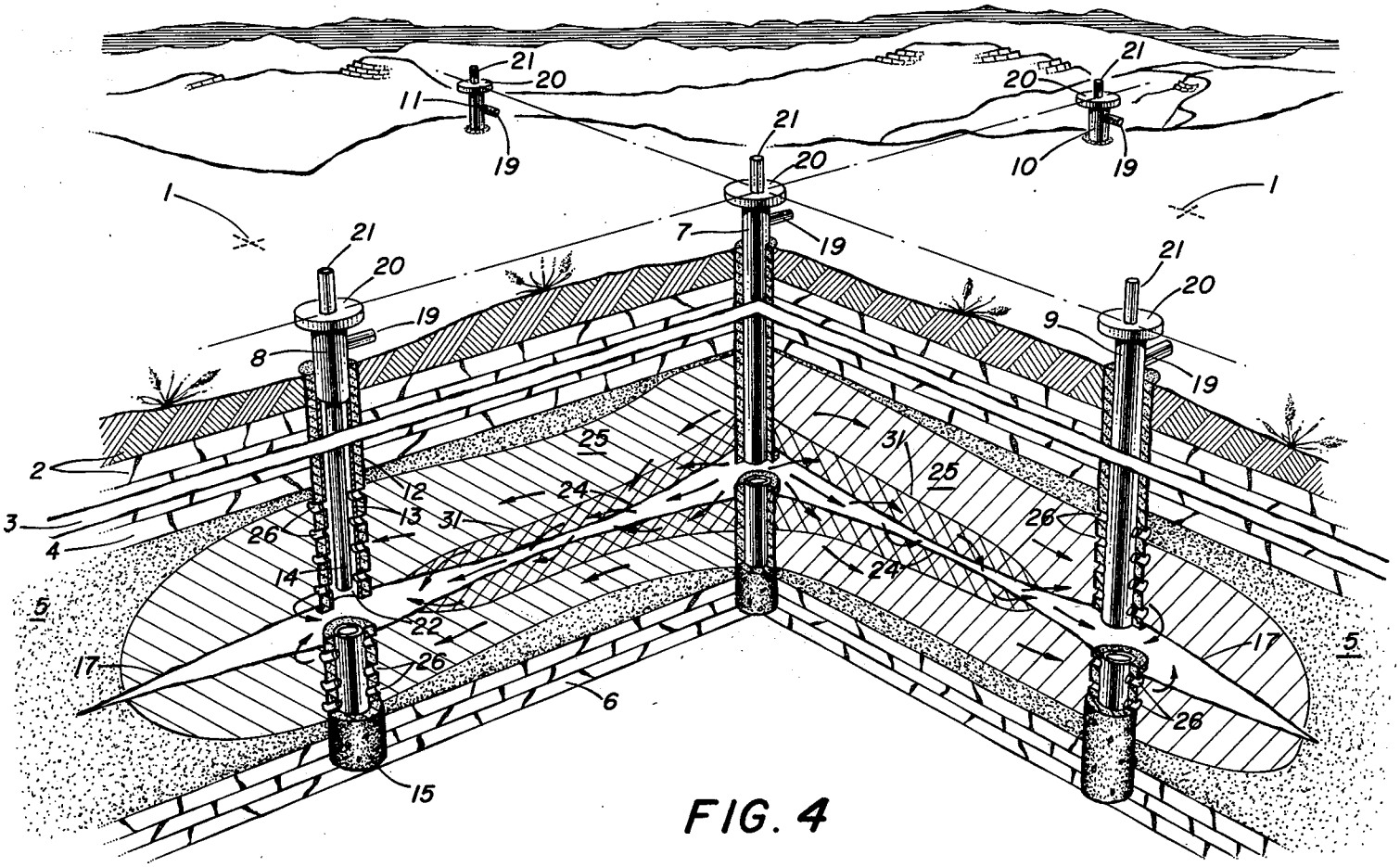
FIG. 4 illustrates a semischematic cutaway cross section of the inverted five-spot at a point in time in the process when conduction heating steam flooding is well under way through the fracture system under pressure sufficient to float the formation, that is to maintain the fractures in an open position.

FIG. 4 illustrates the process at a time well advanced into the high rate steam injection step. Fluids pass as generally shown by the arrows through the floated channel and adjacent thereof effecting conduction heating of the formation as generally shown by zone 25 and 31, and both hot tar and hot water are produced from the production wells by interchange of fluids from the fracture channel into the more strongly heated zone 31 and, to a lessor extent, into the less heated zone 25. Back pressure is held on the production wells sufficient to maintain the fracture system in the floated or parted position, at least until the tar near the fracture communication channel is sufficiently heated to permit free communication of fluids between the injection well and the production wells.

Figure 5:
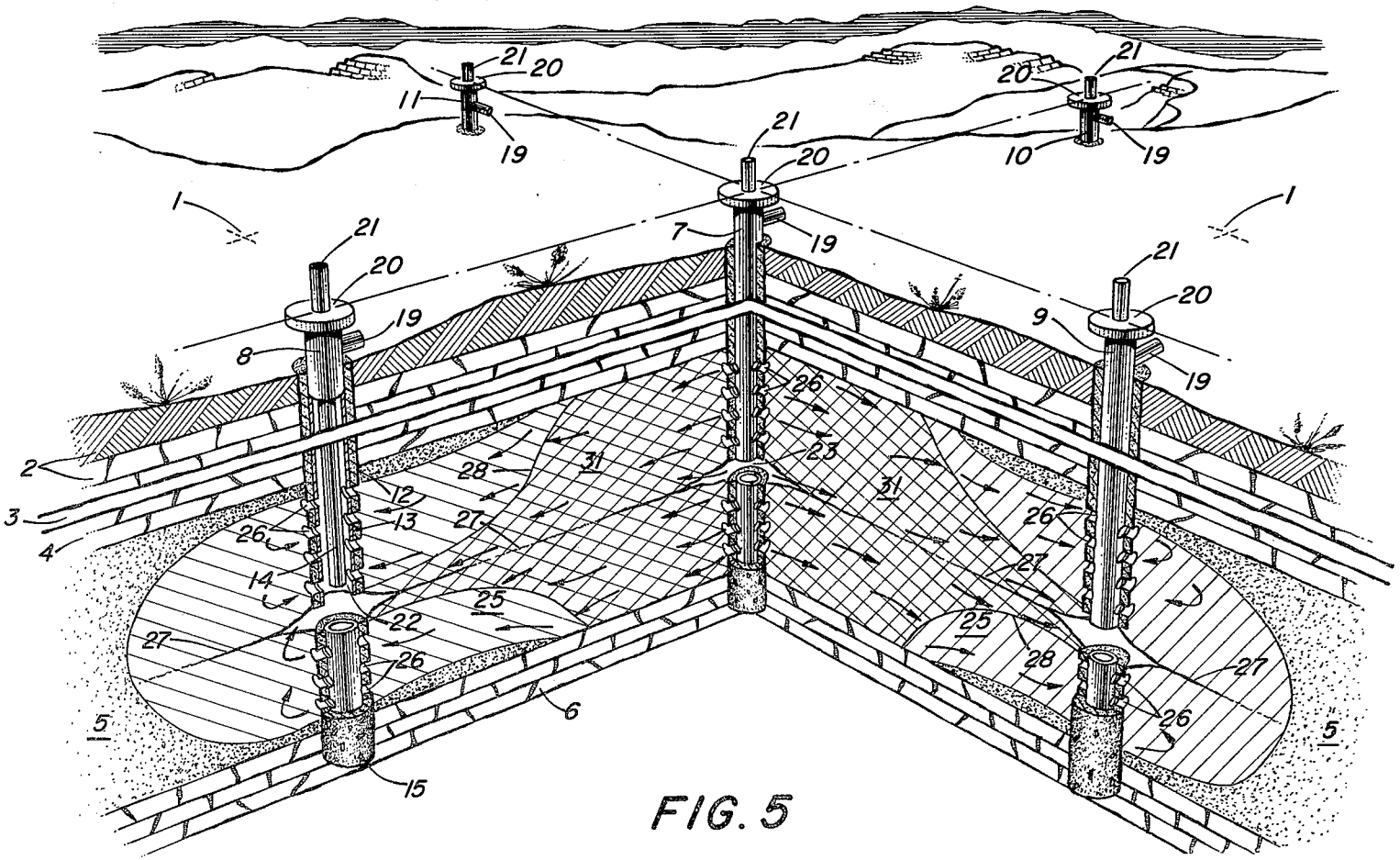
FIG. 5 illustrates a semischematic cutaway cross section of the inverted five-spot at a point in time following establishment of the zone of fluid mobility and increased heat, and it illustrates sweeping of the heated zone of enhanced mobility by a matrix flow steam flood progressing from the injection well to the outlying production wells.

Following conduction heating of the tar in the zone between the wells as shown in FIG. 4, according to the presently preferred mode described, injection rates of steam and reservoir pressures are decreased, allowing collapse of the fracture system, now shown in FIG. 5 as feature 27. Perforations 26 are made in the injection well and steam is injected at a lower rate and pressure to conduct a matrix flow steam flood through the heated zone 25 as shown by front 28 passing between the injection and production wells. Fluid flow is generally shown by the arrows in the tar sand formation.

Matrix flow steam flooding is then conducted at high and economically favorable rates until substantial of the tar is recovered and profitability of continued injection is lost. A high percentage of the tar in the sweep pattern is recovered. Such favorable matrix flow steam flooding is not possible without excessive heat losses prior to establishment of the heated communication zone of enhanced tar mobility.

FIGS. 6 through 9 illustrate stages of another presently preferred embodiment of the invention wherein heavy oil is recovered from a relatively thin, relatively shallow heavy oil deposit, as is noted in the "Brief Description of Drawings" section. Adequate reservoir permeability exists in this embodiment for some fluid mobility in both the horizontal and vertical directions. The oil, though a heavy oil not economically producible without thermal stimulation, is considerably less viscous and of higher API gravity than the tars or bitumens of the Athabasca type. Similar numbers are employed to refer to similar features in these FIGS. 6 through 9.

Figure 6:
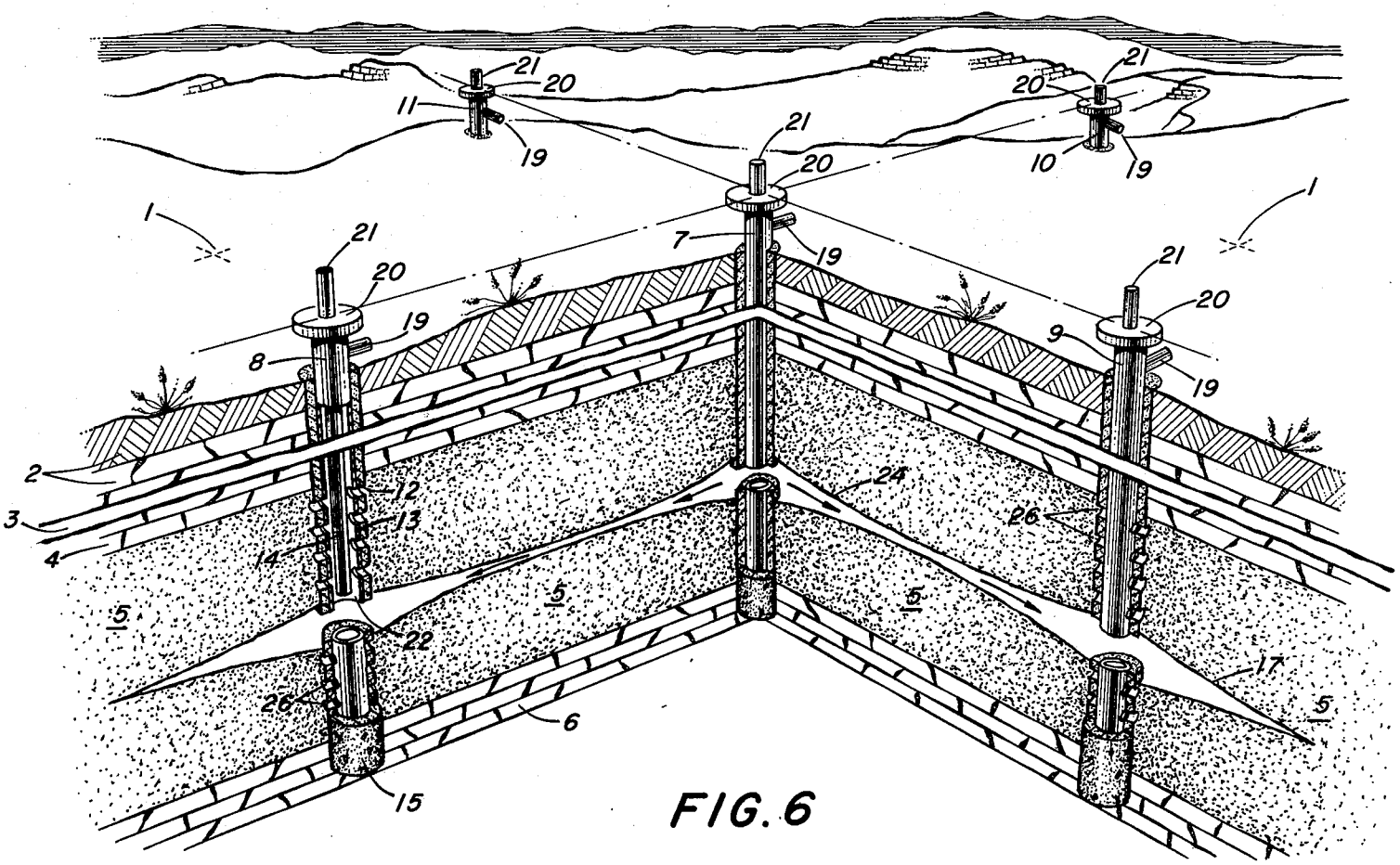
FIG. 6 shows in semischematic fashion, a cutaway section of a relatively thin heavy oil reservoir in which another presently preferred mode of the invention process is under way, employing an inverted five-spot configuration, at a point in time following hydraulic fracturing of each of the four outlying production wells and horizontal hydraulic fracturing of the center injection well of the inverted five-spot.

Thus, referring to FIG. 6, terrain 1 comprising overburden 2 shown with break line 3 and overburden 4 overlie the heavy oil formation 5 which is underlain by stratum 6.

The overburden and heavy oil formation 5 are vertically traversed by an inverted five-spot pattern of wellbores comprised of center injector wellbore 7 and outlying production wells 8, 9, 10, and 11. Each well traversing the heavy oil formation comprises casing 13 cemented to the formation by cement 12 and has tubing 14 communicating to external facilities via outlet 21 through wellhead 20 and forming annulus 22 between the tubing and the well casing which communicates to external facilities through outlet 19. The wells are set through the heavy oil sand formation and cemented to the underlying strata by cement 15.

According to the presently preferred mode now described, each of the production wells is first notched by rotating a hydraulic cutting tool to form notch 16, (shown after collapse of the fracture in FIG. 9 only) and then hydraulically fractured to form horizontal hydraulic fracture 17. Fracturing can be accomplished either by injecting an aqueous fluid through outlet 21 and tubing 14, or through outlet 19 and through annulus 22 into the notch previously formed. The production wells are perforated.

FIG. 6 shows the process after hydraulic fracturing from wells 8 and 9 and after hydraulic fracturing from the center injection well 7 into communication with the fractures established from the outlying production wells.

Figure 7:
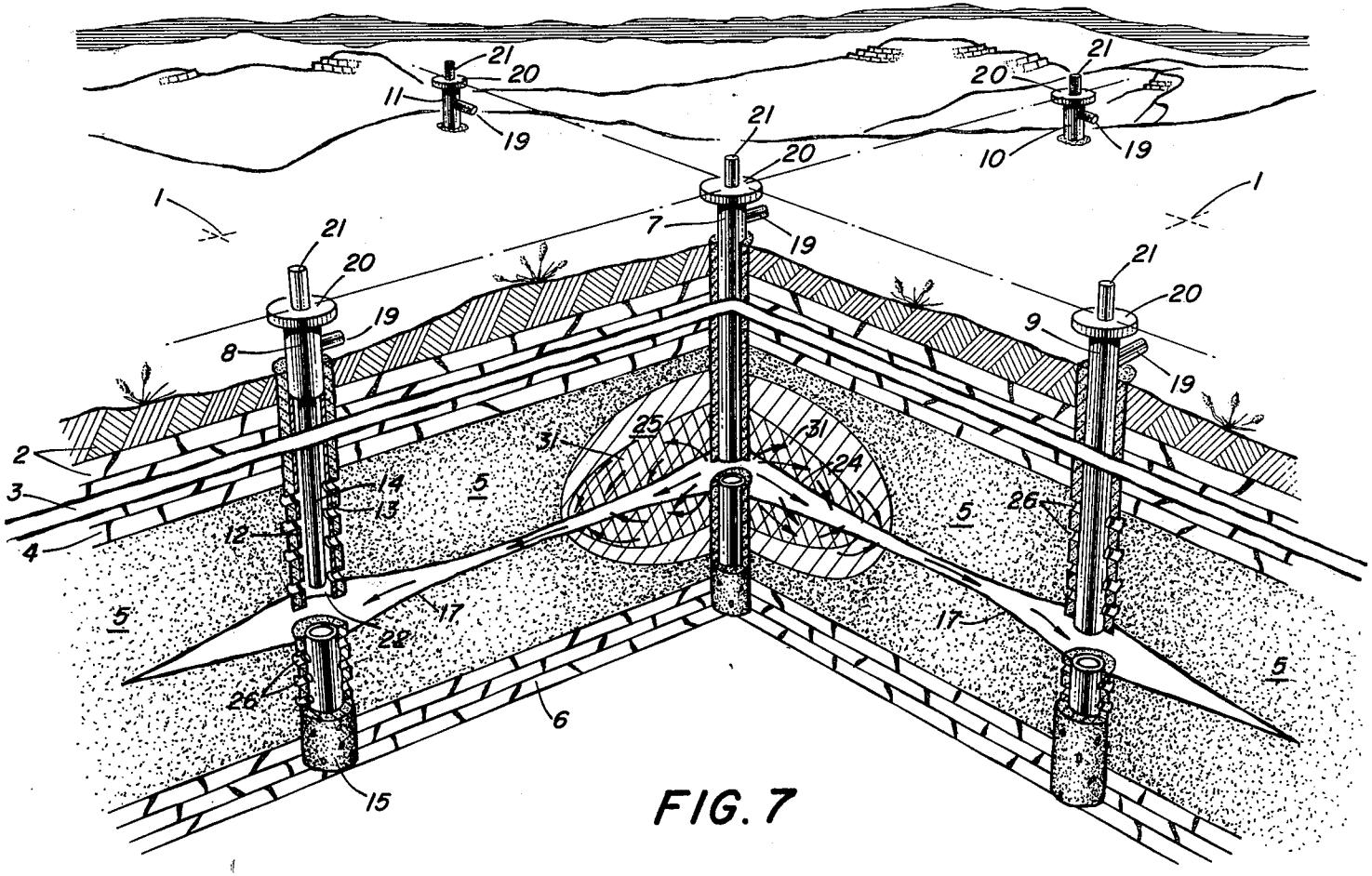
FIG. 7 illustrates a semischematic cutaway cross section illustrating the process shown in FIG. 6 at a later point in time wherein conduction heating steam flooding under floating conditions is under way.

FIG. 7 illustrates the process during conduction heating steam flooding under float conditions by injection of steam into the center injection well. Fluid flow is generally shown by the arrows. Heated zone 25 is formed by vertical conduction heating.

Zone 31, wherein free convection flow is becoming ever more pronounced, is forming, that is, hot steam and water is passing into this zone and heavy oil is being displaced out into the channel formed by the fracture system comprised of 17 and 24. The flow of fluids between the injection well 7 and the production wells 8, 9, 10, and 11 is predominantly through the channels 17 and 24 formed by hydraulic fracturing and floated by the high injection rates and pressures employed.

Figure 8:
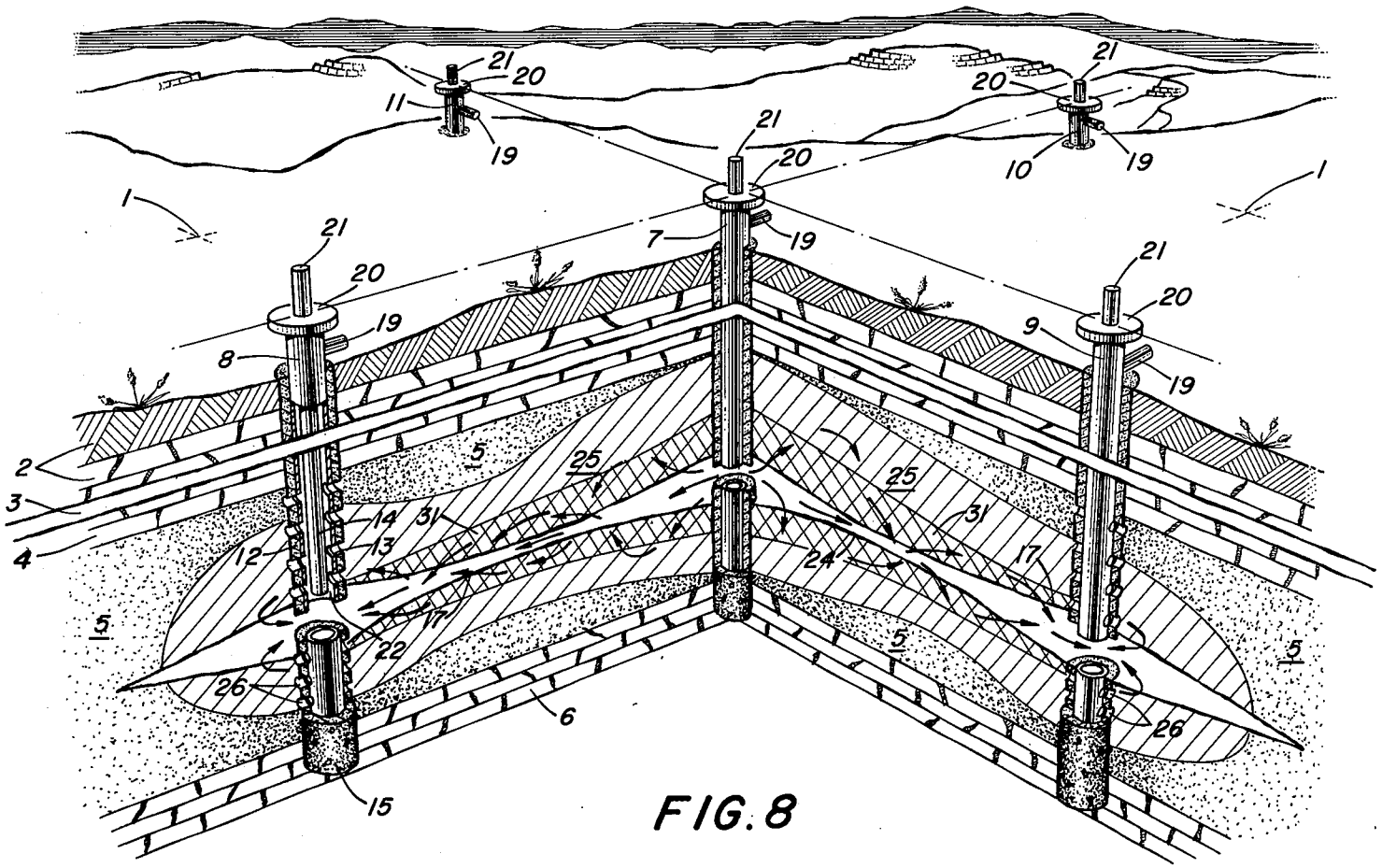
FIG. 8 illustrates a semischematic cutaway cross section of the continuing process at a point in time near the end of conduction heating steam flooding under float conditions.

FIG. 8 illustrates the process at a still later point in time near the end of the conduction heating stem flooding phase comprising steam flooding under float conditions by injecting steam at very high rates into the formation from the center injection well. Heated zone 25 is expanded as shown. Convection zone 31 is also expanded as shown. Fluid flow is generally as shown by the arrows.

Figure 9:
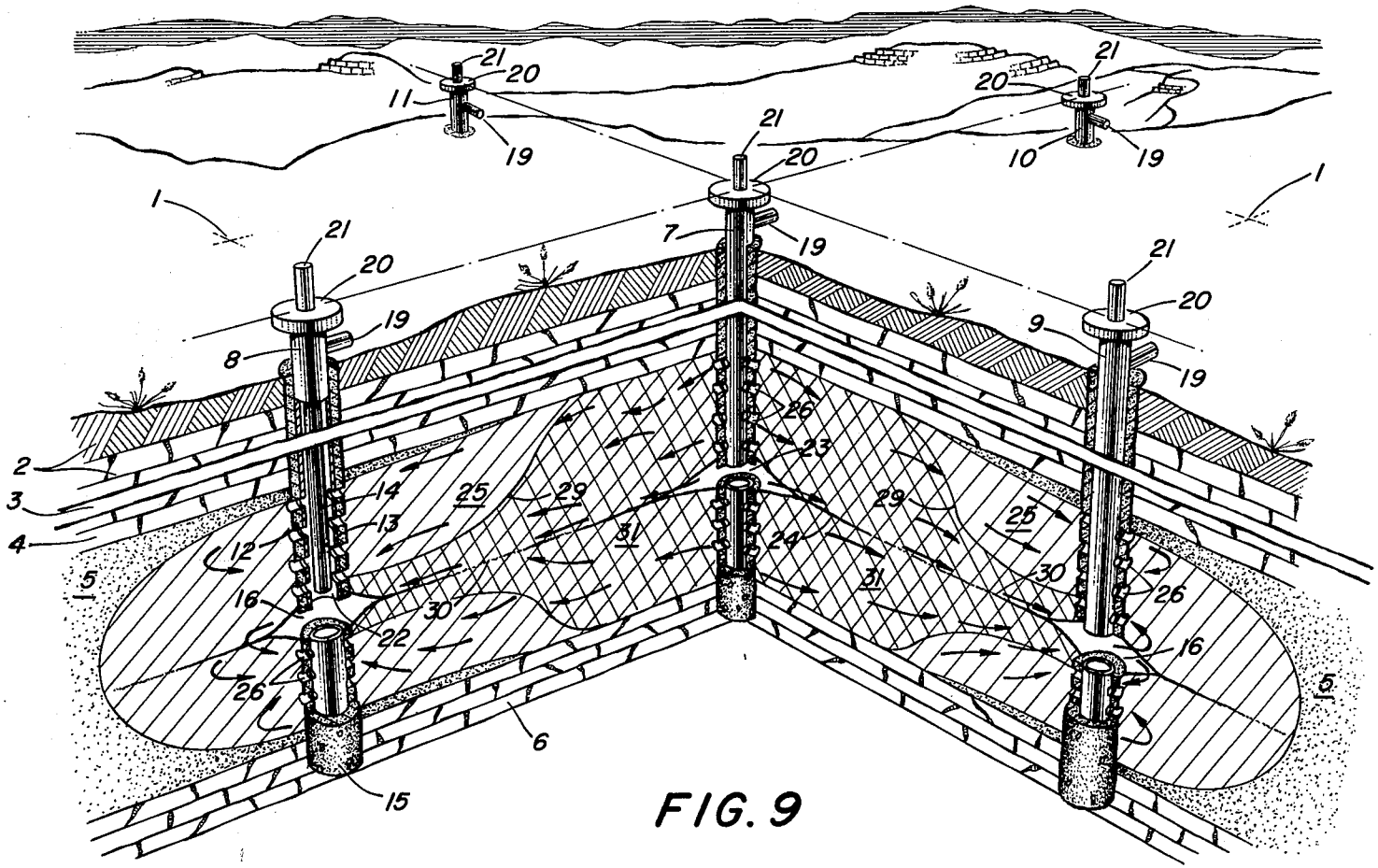
FIG. 9 illustrates the process at a still later point in time wherein matrix flow steam flooding is under way.

FIG. 9 illustrates the process at a still later point in time when predominantly matrix flow steam flooding is under way. Injection rates of steam into the injection well have been adjusted, and reservoir pressure is decreased allowing collapse of the fracture system as shown by healed fracture line 30 near the production wells. The perforations shown had earlier been made in the injection well casing and cement. Steam is injected at a lower rate and pressure to minimize by passing of reservoir zone and to conduct the matrix flow steam flood through the heated zone as shown by front 29 passing between the injection and the production wells. Zones 31 and 25 are expanded as shown. Fluid flow is generally shown by the arrows in the heavy oil deposit and high rates of fluid flow and consequent production are effected by means of the convection zone 31, particularly in the zone around the closed fracture.

The matrix flow steam flood is conducted at the maximum feasible rate (i.e., without excessive channeling of steam and hot water) until operations profitability is lost.

Figure 10:
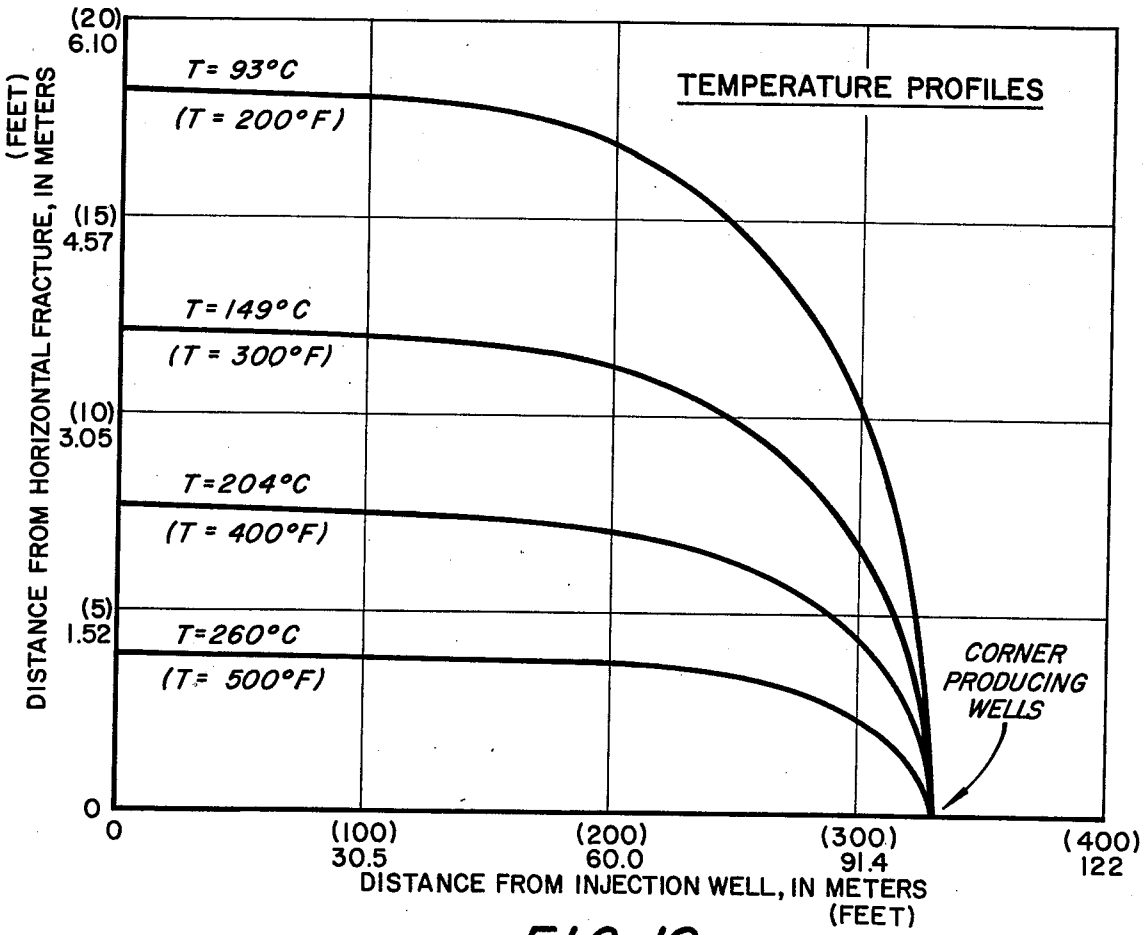
FIG. 10 illustrates temperature distributions perpendicular to the horizontal fracture system at breakthrough in an exemplary application of the invention.

FIG. 10 is later described in the example to which it pertains.

Figure 11:
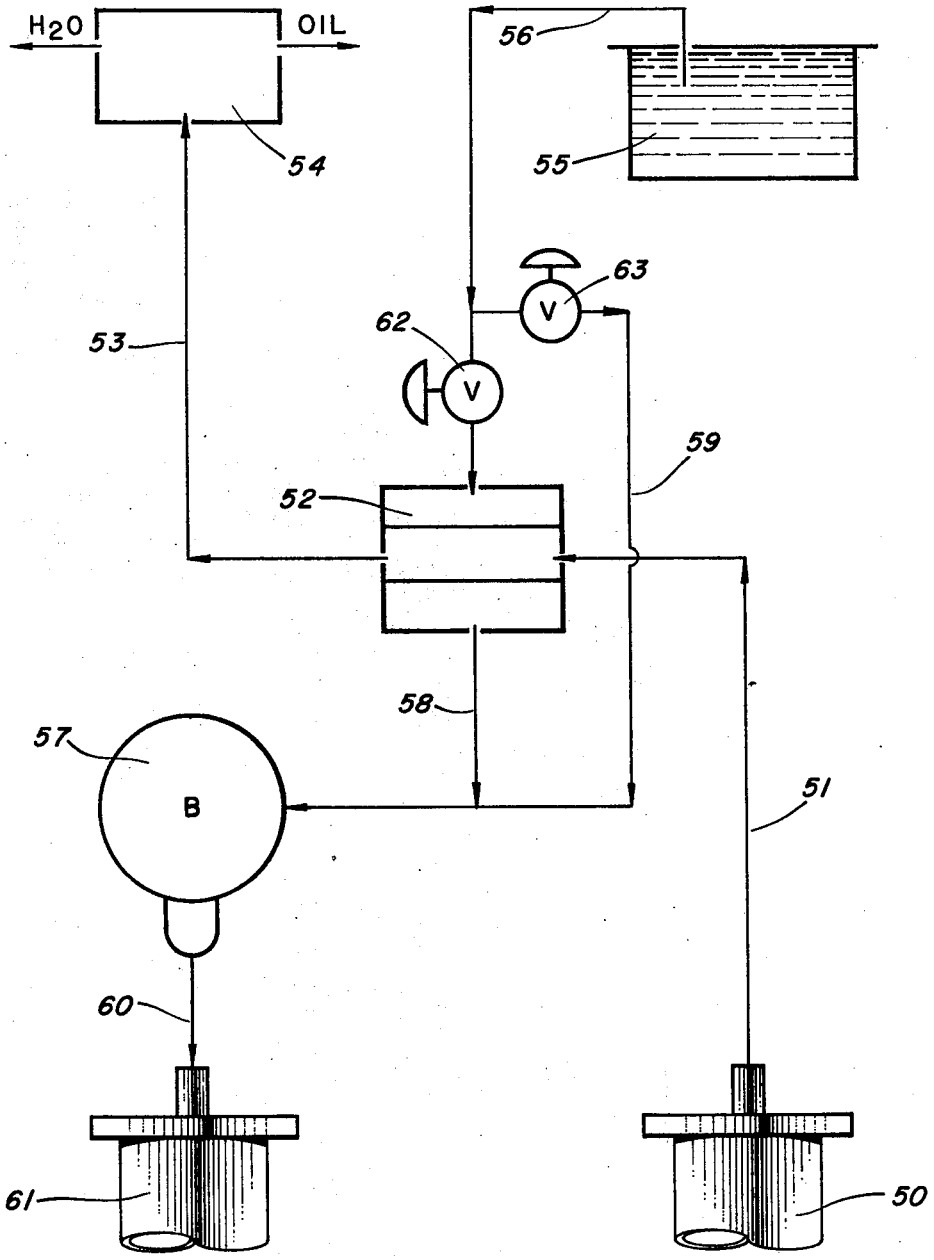
FIG. 11 is a schematic showing extraction of heat from produced fluids for heating water employed to generate steam.

FIG. 11 schematically shows passing of hot produced fluids in heat exchange relationship to water employed to generate steam to recover the heat from the produced fluids and considerably improve economics and energy efficiency of the process.

Hot fluids (tar, steam, water) at temperatures normally of 300°-500° F. (149°-260° C.), but ranging to about 600° F. (316° C.) are produced from producing wells 50, pass through line 51 to heat exchanger 52 and then through line 53 to separator 54 wherein the molten tar and water are separated. Fresh water from fresh water source 55 at temperatures of about 60° F. (16° C.) to 100° F. (38° C.) passes through line 56, heat exchanger 52, and line 58 to boiler 57 where it is converted to steam for passing to injection wells 61 via line 60. Shunt valves 62 and 63 control the passage of water through shunt line 59 or through the heat exchanger to extract the optimum of excess heat from the produced fluids such that the temperature of the produced fluids is lowered to about 180°-200° F. (82°-93° C.) for optimum separation. The shunt valves are preferably controlled automatically by a controller and sensors (not shown) sensing stream.

PREFERRED EMBODIMENTS OF THE INVENTION

Some presently preferred embodiments of the invention have been particularly described in the preceding section in connection with the detailed description of the drawings. Other presently preferred modes are hereinafter described and further elaboration is provided.

In a basic embodiment, the invention relates to establishment of a zone of increased heat and fluid mobility between an injection well and a production well vertically penetrating a heavy oil reservoir by sequentially: hydraulically fracturing between the wells, injection steam into the injection well, and producing fluids from the production well in an improved manner; the improvement characterized by injection of steam at a sufficiently high rate, at a sufficient pressure, and for a sufficient time to maintain parting of the formation along the fracture system between the wells, to effect channel flow of liquids through the parted fracture system, and to effect conduction heating of substantial reservoir volume perpendicular to the direction of channel flow. Preferably the hydraulic fractures established in step (a) are horizontal fractures and steam is injected so as to float the formation along the fracture system and to heat substantial reservoir volume vertically perpendicular to the direction of channel flow.

Also in a basic embodiment, the invention relates to establishment of a zone of increased heat and fluid mobility between an injection well and a production well vertically penetrating a heavy oil reservoir by sequentially: hydraulically fracturing between the wells, injecting steam into the fracture system from the injection well, and producing fluids for the production well in an improved manner characterized by injecting the steam at a sufficient rate, at a sufficient pressure, and for a sufficient time to establish a thermal efficiency for reservoir heating ($TE_{RH}$) of over 40 percent, preferably 70 to 90 percent or higher.

To effect the thermal efficiency of the invention the steam injection rate "$Q_s$"$\geqq 0.2174$ A/h exp[$0.02739 \times TE_{RH}$] when $Q_s$ is expressed in m of $H_2O$ per day, A is expressed in $m^2$, and h is expressed in m.

In all of the embodiments of the invention a zone of increased heat and fluid mobility is rapidly established between the injection and production wells in a thermally efficient manner. The zone is established with good radial and vertical conformance or sweep according to the preferred modes with minimal wasteful heating of overburden and underburden.

The inventive process is presently believed to be applicable to recovery of heavy oil from any type of known subterranean heavy oil containing reservoir.

The inventive process is believed to have particular utility in two classes of reservoirs which are not presently economically producible by known methods.

The first class of reservoirs are those which are relatively shallow and thin such that conventional steam flooding wastes too much heat to surrounding strata at any practical well spacing interval, particularly those having lighter grades of heavy oil, e.g., 10–20 API gravity.

Reservoirs of the first type are typically about 20 to about 600 meters in depth and contain a heavy oil having an API gravity of about 20 to about −2, more usually from about 20 to about 10. Such reservoirs typically have a thickness of about 3 to about 10 meters.

The second type of reservoir for which the inventive process is particularly advantageous are very heavy oil or tar reservoirs, particularly those at relatively shallow depths. Particular utility is found when the heavy oil reservoir is less than about 1500 meters in depth and when the heavy oil has an API gravity of 10 or less. It is even more advantageously employed when the heavy oil reservoir is less than about 600 meters in depth, is comprised of heavy oil and sand which is unconsolidated at temperatures at which the heavy oil is mobilizable, and is substantially impermeable to movement of fluids at reservoir temperatures, in other words, Athabasca type tar sand deposits.

On the basis of actual field demonstration of various aspects, the invention is believed to be pioneeringly commerically applicable to tar sand deposits that have heavy oil of API gravity of 10 or less, that are less than about 1200 meters in depth, that are substantially impermeable to passage of fluids at reservoir temperatures, and that are comprised of heavy oil and sand which is unconsolidated at temperatures at which the heavy oil is mobilizable; specificially, it is believed to be pioneeringly applicable to tar sand deposits of the type represented by the Athabasca deposits and tar sand deposits of Maverick County, Texas.

Techniques for horizontally hydraulically fracturing subterranean formations from wells are known to those skilled in the art.

In the practice of this invention, it is presently preferred to drill the wells through the heavy oil deposit into the underburden and cement the casing into place in a prestressed condition using high temperature cements and high-strength casings.

Notching into the formation is preferably done by use of a reaming tool or a water and sand jetting tool. Sufficient passes are made with the tool to open a window or notch into the formation to effect good initial horizontal orientation of the fracture and of sufficient width that expansion of the casing upon heating of the well upon subsequent steam injection or hot fluid production will not substantially constrict the flow of fluids into or out of the well.

Though there is no inherent limitation on the size of the fractures which are made from the production wells or the injection wells, when an enclosed pattern of the inverted five-spot, inverted seven-spot, inverted nine-spot, or like type of pattern is employed, it is normally most practical to fracture the production wells first and size the amount of fluids injected in the fracturing step to fracture about one-fourth to one-third of the distance from the production to the injection well. However, the production wells can also be explosively fractured or not fractured at all, also in accord with the invention. Thus, for very close spacing and shallow reservoirs, it may be economically preferable to only fracture from the injection wells. In other situations, such as with consolidated reservoirs, particularly those having low permeabilities, it may be advantageous to first hydraulically fracture from the production wells, inject explosive slurries into the fracture system, and then explosively fracture by detonating the explosvie slurries. Fluid injection in fracturing from the injection well is preferably of sufficient size to substantially communicate with the production wells, the fracture system initiated from the production wells, or a heated zone extending from the production wells or fractures therefrom. Any of a number of fracturing fluids can be employed. It is presently preferred to employ aqueous-based fluids such as water or formation brine or the like without proppants or additives. Additives can be employed, but materials which would interfere with subsequent steps of the process are normally avoided. Design of the fracture is such as to preferably horizontally fracture near the vertical middle of the formation. However, there are special reservoir circumstances where a fracture might advantageously be placed near a shale streak, at the bottom of a tar zone, or elsewhere.

The injection phase of the process wherein hot water and/or steam is injected into the injection well and fluids are produced from the production well is conducted in a unique way according to this invention and is distinguished from the prior art. The improved process is characterized by extremely high injection rates and at sufficient pressures and for sufficient times to carry out the following effects: Sufficient pressure is employed that a substantial portion of the length of the fracture system between the injection well and the production well is maintained in a parted position. Channel flow of fluids through a substantial portion of the fracture system is obtained. Conduction heating of a substantial portion of the reservoir volume perpendicular to direction of channel flow is effected such that $TE_{RH} > 40$ percent and that heat losses to adjacent beds are minimized.

Generally, steam is injected during this phase at a rate "$Q_s$" expressed in barrels of water per day which is at least equal to 1812 A/h exp [0.02739×$TE_{RH}$]; wherein A is the horizontal area to be substantially heated between the wells expressed in acres, wherein h is the thickness of the reservoir to be substantially heated expressed in feet, and wherein $TE_{RH}$>40 percent, preferably $TE_{RH}$≧70 percent. In metric terms, "$Q_s$" expressed in cubic meters of water per day is at least equal to 0.02174 A/h Exp [0.02739×$TE_{RH}$]; wherein A is the horizontal area to be substantially heated between the wells expressed in square meters, wherein h is the thickness of the reservoir to be substantially heated expressed in meters, and wherein $TE_{RH}$>40 percent, preferably $TE_{RH}$≧70 percent. Steam injection rates resulting in $TE_{RH}$ approaching 100 percent are demonstrable, though a target rate is generally that at which $TE_{RH}$ is about 80 to 90 percent. Optimization of injection rates for specific reservoirs is well within the skill of skilled petroleum engineers or can be readily determined by routine experimentation and/or computer modeling not amounting to invention.

The preceding injection rates apply only during the high rate injection phase. This phase is preferably continued as long as the predominant fluid injection and transport phenomena occur via fracture channel flow. At the point in time that matrix steam injection and oil displacement becomes substantial, either for natural reasons or because the steam injection rate and pressure are decreased, then the optimum steam injection rate is empirically determined for each project based upon specific oil response and water-cut criteria. This determination is readily made by those skilled in the art by calculations and modeling not amounting to invention.

In some reservoirs, characteristics such as the existence and location of shale streaks and distribution of vertical and horizontal permeability mandate reducing the steam injection rate and pressure in order to effect the transitions from predominantly fracture channel flow to matrix flow. Otherwise, live steam channels are created between injectors and producers. This leads to ineffective oil displacement, as reflected by high water-cuts (WOR) and poor thermal efficiency as evidenced by high steam-oil ratios (SOR).

In some reservoirs, particularly those characterized by substantial vertical reservoir permeability and integrity and oil viscosity characteristics such that the oil becomes mobile on only moderate heating, a convection mechanism becomes significant. In other words, as the heated fluids are propagated through the floated fracture channel from the injection well to the production well, heating in a perpendicular direction to the direction of flow is always effected. This is predominantly conduction heat transfer. However, in reservoirs having substantial vertical permeability and good heat reduction of oil viscosity, more and more oil is flushed by convection type effects (including gravity displacement phenomena, steam distillation, vis-breaking, and the like) into the fracture channel. As more and more mobilized oil is flushed, convected, or displaced from the matrix near the fracture channel, more and more steam and/or hot water moves out of the fracture channel to further promote the displacement. In such reservoirs, a gradual transition occurs from predominantly fracture channel flow wherein heat transfer is effected predominantly by conduction to a combination of fracture and matrix flow, initiating from the injection well and propagating to the production well. In such combination of fracture and matrix flow, both conductive and convective heat transfer mechanisms become substantial. In such situations, the conduction heating channel flow process gradually naturally converts to a matrix flow process as fluids are continued to be passed from the injection to the production well.

In other reservoirs such as in typical tar sand or bitumen sand reservoirs, the transition from predominantly fracture channel flow to some combination of both fracture channel and matrix flow does not readily occur. In such reservoirs it becomes necessary, at such time as adequate reservoir heating as occurred in the zone radial to the fracture channel as a result of conduction heating from fracture channel flow of fluids, to draw down or pump off the production wells so as to create large effective pressure sinks and to decrease the steam and/or hot water injection rate and pressure such that the floated fracture system is substantially closed and such that predominantly matrix flow and heavy oil displacement results.

When a tar sand or heavy oil deposit having an API gravity of less than about 10 which is less than about 1500 meters in depth and which is substantially impermeable to fluids at reservoir temperature, that is, a so-called tar sand deposit is encountered, the following embodiment of the invention is advantageously employed. A zone of heated tar mobility horizontally traversing the tar sand deposit is established by the following sequential steps: The tar sand formation is penetrated with an injection wellbore and a production wellbore horizontally separated from each other. The formation is horizontally hydraulically fractured from the production well. Hot water and/or steam is temporarily injected into the production well to float the fracture zone established by the hydraulic fracture and to impart heat, thus producing a better target for the fracture communication channel which is later propagated from the injection well. The formation is then horizontally hydraulically fractured from the injection well to establish fluid communication to the production well. Hot water and/or steam is injected into the injection well at sufficient rate and pressure to float the formation system between the wells and thus form a heated channel of mobilizable tar in the formation in proximity to the fracture system between the wells. More steam and/or hot water is passed into the injection well and fluids pass through the heated permeable channel between the wells to effect conduction heating flooding. It is believed that heat from the hot aqueous fluid is conducted vertically and radially away from the fracture while hot aqueous fluid accompanied by some flushed or stripped tar is conveyed from the matrix through the channel of the floated fracture or near the floated fracture, and is recovered from the production well. After proper conduction preheating under fracture floating conditions, very efficient tar recovery occurs during the subsequent matrix displacement phase. Advantageously, once optimum heating of the permeable zone between the wells is effected by the conduction steam flooding, the fracture system is allowed to collapse by producing down and/or pumping from the production wells, and then a conventional but relatively high rate matrix flow drive front of steam, combustion, water modified combustion, oxygen enhanced steam, caustic enhanced hot water, or hot water is passed through the heated zone by injecting suitable materials into the injection well and producing fluids from the production well. According to a presently preferred embodiment, a drive front of steam or hot water is passed from the injection well to the production well by matrix flow.

In accordance with another embodiment, it is advantageous, after the completion of the fracture preheat phase, to refracture from the injection well, as with steam. Small fractures can also be propagated and propped from the producing wells. Such embodiments lead to increased productivity during the matrix steam displacement phase and help prevent wellbore plugging due to solidification of viscous heavy oil or tar particularly if the fractures are propagated or stimulated with steam. Huff-and-puff steam cycles on production wells can be effectively used to maintain sufficient fluid production during the matrix flow steam flooding operations.

Perforation of production wells is usually advantageous. Open hole completions can be employed in consolidated reservoirs with some modes.

Severe problems may be encountered with plugging of the production tubing as the heated tar or heavy oil moves toward the surface and cooler regions of the well, particularly when producing extremely viscous tars or heavy oils. According to a presently preferred aspect of the invention, a thinning agent for the produced heavy oil or tar, such as a light hydrocarbon solvent, or water plus emulsifying agent, is injected down a parallel string of tubing next to the production tubing or down the annulus of the production well to the production horizon to there mix with the heavy oil, thus thinning it or increasing its gravity and preventing plugging of the production tubing by congealing of the heavy oil. The thinning agent can also be injected down hollow sucker rods to the production horizon. A number of suitable diluents such as KD (kerosene distillate) and surfactants suitable for such purposes are known to those skilled in the art.

According to another aspect of the invention, economics and energy conservation are substantially further improved by passing hot fluids that are produced from the production well through a heat exchanger in heat exchange relationship with water employed to generate steam in order to preheat the water employed for steam generation.

The terms "floating" and "parting" of formations are employed in a number of instances in this application. As employed herein, the expressions mean that fluids such as hot water and/or steam are employed at sufficient rates and pressure to reopen or maintain a hydraulic fracture (i.e., a pressure parting induced in the earth's strata by injection of fluids at above parting pressures) in the open position. "Floating" is employed in reference to horizontal fractures, "parting" is employed in reference to both horizontal and vertical fractures.

In one embodiment, a multiplicity of center injection wells and a multiplicity of outlying production wells are employed in a replicating inverted five-spot, inverted seven-spot, or inverted nine-spot configuration. The terms inverted five-spot, etc., are well known terms of art in this field of technology. For instance, from an overhead view, the inverted five-spot looks like the five face of a die wherein the injection well is in the center and the production wells form a square surrounding it. For replicated patterns, the configuration can be viewed as either inverted or not as applying to interior wells in the pattern.

In another embodiment a line drive configuration can be employed.

A multiplicity of injection wells and of production wells are advantageous for commercial operation. It is presently preferred that at least two production wells be employed for each injection well although one production well or more for each injection well is suitable. If pattern development such as the inverted five-spot type or the like are employed, it is preferred that spacing be no more than 15 acres ($6.07\times10^4 m^2$). Preferably, spacing is 1.25 to 10 acres ($5.06\times10^3$ to $4.05\times10^4 m^2$). Patterns may be treated singly or in groups, and operations can be staged to accommodate the various phases of the process.

In order for the process of this invention to be operable for a candidate reservoir, the heavy oil or tar must be decreasable in viscosity by application of heat to a degree sufficient that it will flow upon application of hydraulic pressure. Heavy oil and tar sand deposits are generally of this type, and mobility is normally established at temperatures of about 150° to 250° F. (66° to 121° C.).

EXAMPLES

The following examples are provided in order to more fully explain the invention and provide information to those skilled in the art on how to carry it out. However, it is to be understood that these examples are not intended to function as limitations on the invention as described and claimed herein.

Application of one mode of the invention is described as applying to a relatively thin heavy oil reservoir. One example of such a relatively shallow, relatively thin heavy oil deposit is in the Loco field, Stephens County, Oklahoma. This field contains exemplary thin Permian sands at 200 feet (61 m) and 500 feet (152 m) of depth. The zones are 18 feet (5.5 m) and 12 feet (3.7 m) thick, respectively. Each sandstone reservoir is 74% oil saturated and has negligible gas saturation. At reservoir conditions, the oil viscosity is over 700 cp (0.7 Pa.s) in the 200-foot (61 m) zone (the so-called "J" zone) and 200 cp (0.2 Pa.s) in the 500-foot (152 m) zone (the so-called "B" zone). The heavy oil has an API gravity of 20 and has very low mobility under natural reservoir conditions. Earlier attempts to use enhanced recovery processes involving water flooding, hot water flooding, huff-and-puff steam stimulation, and water enhanced combustion drive, although recovering some oil, were not considered successful.

To exemplify a mode of the process of the invention which appears particularly applicable to such relatively thin and shallow heavy oil deposits, the following completion procedure is effected. Inverted five-spot patterns are drilled and logged. Each pattern contains approximately 2.5 acres ($10.1\times10^3 m^2$). Induction logs and gamma ray density logs are run and two wells are cored to determine formation thickness reservoir sand quality, porosity, and saturations. Five and one-half inch (14.0 cm), 15.5-pound per foot, (23.1 kg/m) J-55 class casing is run to total depth and is cemented to the surface with Class H cement containing 40 percent silica flour and 2 percent calcium chloride.

In preparation for stimulation, the casing is hydraulically notched in the center of the pay section using field salt water laden with 1 ppg (120 $kg/m^3$) 20–40 mesh sand. The mixture is pumped down 2 ½-inch (6.4 cm) tubing and through a nozzle at about 3.7 barrels per minute (0.59 $m^3$/min. The tubing is rotated, creating the notch. Injection wells are notched a second time, one-half inch (1.27 cm) above the first notch, to permit the very high steam injection rates of the invention and prevent casing expansion during steam injection from shutting off or impeding the flow of steam into the formation. The notching also aids in the creation of a horizontal fracture during the facturing step of the procedure.

Each well of the inverted five-spot pattern is then in turn fractured with field salt water containing no additives or sand at a rate of 40 barrels per minute (6.36 $m^3$/min). Because of the relatively soft and unconsolidated nature of the reservoir, no proppant is used. No fluid loss or gelling agents are used since inhibition of steam and hot water leakoff from the fracture is not desired. The horizontal fractures from the producing wells are designed such that the horizontal hydraulic fracture radius equals about one-half of the distance to the injection well, that is, about 115 feet (35 m). Because of relatively close well spacing and only moderately-high viscosity oil in the reservoir, steam stimulation of the producers is not deemed necessary or effected in this example.

Upon completion of the hydraulic fracturing from each of the outlying producing wells in the five-spot, the producers are perforated over the entire formation interval with two shots per foot (6.6 shots/m).

Thereupon, the center injection well of the inverted five-spot is notched in a similar manner and a relatively massive hydraulic fracture is established from the notch to create a horizontal hydraulic fracture outward for a distance of about 230 feet (70.3 m) to reach each producer. Each producer is monitored with a pressure gauge and fluid level sounder to record response to injection treatment. The injection well is not preforated.

The production wells are equipped with 2 $\frac{7}{8}$-inch (7.3 cm) tubing, 2 $\frac{1}{8}$-inch (5.4 cm) rod pumps, and 80,000-inch pound (922 Kgm) pumping units.

The injection wells are equipped with 2 $\frac{3}{8}$-inch (6 cm) tubing with an expansion joint and thermal packer. The packer is set about 20 feet (6.1 m) above the notch in the casing. Wellhead connections include a termocouple, pressure gauge, and a sampler with a cooling coil for quality measurements. The casing-tubing annulus is vented to prevent overpressuring and overheating the casing.

Steam is provided by a conventional 25 million Btu per hour (26 GJ/hr) generator. The unit is capable of heating 1500 barrels of water per day (238) ($M^3$/day) to 80 percent quality steam and has an outlet guage pressure rating of 2500 psig (17.2 MPa). A set of two anthracite coal water filters, one water softening unit containing four sodium zeolite treaters, a filtered water storage tank, and a brine tank are used to treat and provide water to the generator.

In one exemplary application of the inventive process, an inverted five-spot pattern is completed traversing the so-called "J" reservoir at about 200 feet (61 m). The producers are treated with a 3500-gallon (13.2 $m^3$) fracture treatment and the injector is treated with about 180,000 gallons (681 $m^3$). Communication with the producers during the fracturing of the injection well is evidenced by the wells filling with fluid and exhibiting over 35 psi (0.24 MPa) surface guage pressure by the end of the hydraulic fracturing of the center injection well of the inverted five-spot.

Immediately upon completion of the fracturing of the center injection well, steam injection is initiated at a rate "$Q_s$" of about 900 barrels (143 $m^3$) of water per day as 70 percent quality steam, or a 340 million Btu per day (359 GJ/day) injection rate. Wellhead injection guage pressure is 325 psig (2.24 MPa) and injection temperature is 375° F. (191° C.). "A" is 2.5 acres and h is 18 feet. Therefore $TE_{RH}$ is calculated from the equation $TE_{RH} = 36.51 \ln [Q_s h/1812A]$ to be approximately 50 percent. When matric units for $Q_s$, h, and A are used, $TE_{RH} = 36.51 \ln [46 Q_s h/A]$. Demonstration that the steam is being injected at a sufficiently high rate, at a sufficient pressure and/or a sufficient time to float the formation along the fracture system between the wells, to effect channel flow of fluids through the floated fracture system and to effect conduction heating of substantial reservoir volume perpendicular to the channel flow is indicated by production response occurring the next day in one of the production wells and by production of 200 barrels (32 $m^3$) of oil per day from the pattern in less than 7 days.

Temperature response is noted in the production wells after two weeks of producing at a rate of 200 barrels of oil per day (32 $m^3$) with wellhead temperature increasing from 80° F. (27° C.) to 110° F. (43° C.). Such a response occurs after about 12,000 barrels (1907 $m^3$) of water (as steam) or 4.7 billion Btu (5.0 GJ) are injected into the injection well. After 39 days, the temperature is noted to rise to about 225° F. (107° C.) in the production wells. Daily production for the inverted five-spot averages over 200 barrels of oil per day (32 $m^3$) for several months.

Thereupon, steam injection is terminated and water is injected into the injection well to scavenge heat and provide for a matrix-flow hot-water drive flood of the reservoir. Considerable additional quantities of oil are produced.

This example demonstrates the application of a mode of the invention for economically viable recovery of a heavy oil from a relatively thin, relatively shallow heavy oil reservoir from which oil was not ecomonically recoverable by prior art processes. Of course, optimization of the process and variations therein are within the skill of those skilled in the art for the reservoir described as well as for many similar reservoirs.

According to another mode of the invention, the process is described with reference to a very heavy oil or tar sand reservoir.

A resource of particular interest is the tar sand or heavy oil deposits in Maverick and Zavala Counties of south Texas, which are estimated to contain 10 billion barrels ($1.6 \times 10^9$ $m^3$) of very heavy oil or tar having an API gravity of $-2$ to $+2$. This resource is quite similar to the Athabasca type of tar sand, but is generally of even higher viscosity and lower API gravity, and thus more difficult to devise production processes for. An exemplary San Miguel sand of the resource averages about 50 feet (15 meters) in thickness with a permeability of about 500 to 1000 millidarcies (0.5 to 1 $(\mu m)^2$) and about 30 percent porosity. Initial oil saturation is about 55 pore volume percent and depth of the exemplary San Miguel 4 sand is about 1500 feet (457 meters). Various attempts have been made to produce these tar deposits over the years, and although some tar has been produced in some of the projects, none have yet been considered economically successful. Additionally, none of the produced tar has ever been sold due to dehydration difficulties. The heavy oil from the reservoir has a 180° F. (82° C.) pour point and the reservoir is essentially solid and nonpermeable to passage of fluids at natural reservoir temperature. Upon heating, the tar becomes mobile, and while the sand grains of the reservoir are in grain-to-grain contact, they are not cemented together, that is, the reservoir is largely incompetent at temperatures at which the tar is mobile.

To aid those skilled in the art in carrying out a mode of the process which is particularly advantageous in recovering tar from such deposits, the following description is provided.

The reservoir is vertically traversed by an inverted five-spot well configuration comprising four production wellbores with an injection wellbore in the center. The five-acre (20234 $m^2$) pattern encompasses a square at the top reservoir surface wherein the production wells are 467 feet (142 m) apart and the distance between the center injection well and the production wells is 330 feet (100 m). The reservoir thickness is 45 feet (13.7 m) of net pay and at 1500 feet (457 m) of depth at the five-spot pattern site. Reservoir temperature is 100° F. (37.8° C.), pressure is 675 psia (4.65 MPa), and oil saturation is approximately 1400 standard barrels per acre foot [0.181 $m^3/m^2 \cdot m$]. Pour point of the tar is about 180° F. (82° C.). All wells have 7" (17.8 cm) O.D NM-80 grade 23#/ft (34.3 Kg/m) casing set through the tar sand interval to a depth of about 1750 feet (533 m) and cemented into place with high temperature components suitable for a thermal recovery project. All wells are completed with prestressed casing to prevent failures due to thermal expansion when heated with steam at 600° F. (315.5° C.). The wells generally have a completion configuration as shown in FIGS. 1 through 4.

Two 25 million Btu per hour (26 GJ/hr) oil fired steam generators are manifolded together on site. Their probable steady state output is rated at 3200 barrels (508 $m^3$) of water per day of wet steam at 615° F. (324° C.), 1725 psia (11.9 MPa), and 75 percent quality.

The production wells of the inverted five-spot are notched near the vertical center of the tar deposit with a rotatable notching tool, a high-speed jet of water and sand, which cuts through casing and cement and notches back into the formation. Repeated passes are made to form a notch of sufficient width that heating of the wells does not restrict or close off the window to the formation. The tool has uniplanar 120° phasing $\frac{3}{8}$" (0.95 cm) orifices. It operates at 3000 (20.7 MPa) psi and 3.5 BPM (0.56 $m^3$/min) employing 1 ppg (120 kg/$m^3$) 20–40 mesh frac sand. Thirty minutes are used per cut while rotating 6–10 rpm.

Thereupon, each of the production wells is hydraulically horizontally fractured with water in sufficient quantity to open a hydraulic fracture approximately one-third of the distance between the production well being fractured and the center injection well. Frac jobs consist of about 55000 gallons (208 $m^3$) of fresh water injected at rates between 30–40 BPM (4.8–6.4 $m^3$pm). Since the fluid is injected down 3 $\frac{1}{2}$" O.D. (8.9 cm) tubing drag reducer is added. Immediately after fracturing each well, high pressure steam is injected in turn in each of the production wells at a rate of 1600 barrels of water per day (254 $m^3$ $H_2O$/day), 600° F. (316° C.), 75 percent quality, and 1700 psia (11.7 MPa) pressure to impart about 15 billion Btu's (16 GJ) of energy into each of the production wells. This results in floating of the formation (maintenance of the hydraulic fracture in the open position) and formation of a heated radius of about 144 feet (44 m) surrounding each of the producing wells and heating of the formation to a temperature greater than about 200° F. (93° C.) for a distance of about 10 feet (3 m) above and below the horizontal fracture path previously formed.

This steam stimulation is accomplished by using one of the generators per well. Upon completion of injection into the four wells, all four wells are perforated employing 4 shots per foot (13 shots/m). All four wells are then "topped off" by injecting steam simultaneously into all four wells for a short time and then shutting in for steam soak to effect the heating of the reservoir previously described.

After steam soaking of the production wells and subsequent release of pressure therefrom, the center injection well is horizontally hydraulically fractured through the notch located at or near the vertical center of the tar sand formation to effect communication with the fractured and steam stimulated zones surrounding each production well. Back pressure on the production wells is employed as needed to distribute the fracture over the pattern.

Immediately, while holding back pressure on the formation through all of the wells as needed to maintain the fracture in a floated condition, steam is injected into the injection well at a rate of about 3200 barrels (509 $m^3$) of water per day, 75 percent quality, 615° F. (324° C.), 1725 psia (11.9 MPa) to float the formation between the wells along the fracture system between the wells, to effect channel flow of liquids through the floated fracture system, and to effect conduction heating of substantial reservoir volume vertically perpendicular to the channel flow. Back pressure is adjusted on the production wells as needed to radially distribute the heat over the formation. Heat breakthrough to the corner wells is at about 102 days. A reservoir heat distribution plot at that time is shown in FIG. 9. The x-axis or horizontal axis represents the horizontal fracture system. The temperature distribution within the fracture system at this point in time is about 615° F. (324° C.) which is about the bottom hole temperature of the injection well. The temperature distribution is nearly the same above and below the fracture system, hence, only profiles above the fracture system are shown. The 200°, 300°, 400° and 500° F. (93°, 149°, 204°, and 260° C.) isotherms are shown. At time of breakthrough about 15 percent of the pattern volume has been heated to temperatures exceeding 500° F. (260° C.), 30 percent exceeds 400° F. (204° C.), and 47 percent exceeds 300° F. (149° C.). Near the injection well the 200° F. (93° C.) isotherm is about 18.5 feet (5.64 m) vertically above and below the fracture, and 70 percent of the pattern exceeds this temperature from steam injected from the injection well. "Q" is 3200 barrels of water per day (509 $m^3$/d), h is 45 feet (13.7 m), and A is five acres (20235 $m^2$). The $TE_{RH}$ is calculated to be greater than 90 percent, and the amount of heat lost outside the reservoir is relatively small. Steam earlier injected into the production wells modifies these profiles near the production wells somewhat as is indicated in FIGS. 3 and 4.

Each production well is equipped for injection of a thinning agent for the heavy tar at a point near where the tar is produced from the formation by hanging two strings of tubing. The production string is 3 $\frac{1}{2}$" O.D. (8.9 cm) 9.2#/ft (13.7 Kg/m) tubing. The diluent injection string is 1.660" O.D. (4.22 cm) integral joint tubing. Thinning agents such as kerosene, surfactant plus water, and the like are employed to prevent plugging of the production tubing when the heavy tar passes to cooler regions near the surface of the earth.

Steam is continued to be injected at this high rate and pressure to float the formation along the fracture system and to form a heated channel of mobilizable tar in the formation in proximity to the fracture system between the wells for a time calculated to effect optimum heating of the reservoir in the pattern. Fluids, including very substantial production rates of tar, are produced from each of the outlying production wells.

Hot fluids being produced from the production wells are directed through a heat exchanger to heat the water used to make steam for injection, thus considerably improving the economics of the process. The cooling of the produced fluids by the heat exchange also promotes effective operation of surface separation facilities used to recover the tar from the produced steam and hot water.

After considerable time has lapsed and production is effected by the injection of steam at high rates, it is calculated that optimum heating of the reservoir in the pattern is obtained, as described elsewhere in this application, or steam breakthrough is observed. Thereupon, the rate of steam injection at the injection well is decreased, the production wells are allowed to produce at maximum rates and are drawn down, thus allowing the closing of the fracture system near the production wells.

Thereupon, the injection well is perforated and steam is injected at maximum matrix-flow drive rates from the center injection well to effect a rapid matrix-flow steam flood of the pattern which has now been heated by the procedures previously described.

In another embodiment, the process is repeated as just previously described, but water heated by produced fluids and containing caustic is injected into the injecting well instead of the relatively lower-pressure and low-rate steam in the matrix-flow step.

Alternatively cold water, air, air and cold water, and/or other gases are also used during the matrix-flow displacement step.

We claim:

1. In a process for establishing a zone of increased heat and fluid mobility between an injection well and a production well vertically penetrating a heavy oil reservoir comprising sequentially:

(a) horizontally hydraulically fracturing between the wells, (b) injecting steam into the injection well, and (c) producing fluids from the production well; the improvement comprising: injecting the steam at a very high rate, at a sufficient pressure, and for a sufficient time, while simultaneously producing fluids from the production well such as to:

(d) maintain parting of the formation along the fracture system between the wells, to (e) effect channel flow of liquids through the parted fracture system between the wells, and to (f) effect conduction heating of substantial reservoir volume perpendicular to the channel flow between the wells;

wherein the steam is injected at a rate "$Q_s$" expressed in cubic meters of water per day which is greater than or equal to 0.02174 A/h exp $(0.02739 \times TE_{RH})$, wherein A is the area to be substantially heated between the wells expressed in square meters, wherein h is the thickness of the reservoir to be substantially heated expressed in meters, and wherein $TE_{RH}$ is a rational positive number in the range of 0.4 to 1.0.

2. The process of claim 1 wherein $TE_{RH}$ is a rational positive number in the range of 0.7 to 0.9.

3. The process of claim 2 wherein the heavy oil reservoir is less than about 1500 meters in depth, and wherein the heavy oil has an API gravity of 10 or less.

4. The process of claim 3 wherein the heavy oil reservoir is less than about 600 meters in depth, is comprised of heavy oil and sand which is unconsolidated at temperatures at which the heavy oil is mobilizable, is substantially impermeable at reservoir temperatures, wherein substantially impermeable at reservoir temperatures, wherein the hydraulic fractures are initiated by notching into the formation from the initiating well, and wherein an aqueous fluid is employed as a hydraulic fracturing agent.

5. The process of claim 4 wherein the horizontal hydraulic fracturing between the wells of step (a) is carried out in the following improved manner: the reservoir is first hydraulically fractured near the production well and from the production well, thereupon steam is injected via the production well into the first fracture to float the first fracture and impart heat to the reservoir near the production well via the first fracture; and thereupon the formation is secondly hydraulically fractured from the injection well, the second hydraulic fracture establishing fluid communication with the production well; and thereupon, steps (b) and (c) are effected in the improved manner claimed.

6. The process of claim 3 wherein A is not greater than $5 \times 10^4$ m$^2$; wherein $TE_{RH}$ is a positive rational number in the range of 0.7 to 0.9; wherein matrix flow steam flooding is subsequently effected from the injection well to the production well with heavy oil production from the production well; wherein a thinning agent for the produced heavy oil is injected to the production horizon of the production well and there admixed with the produced heavy oil to prevent plugging of the production well tubing by congealing of the heavy oil; wherein the heavy oil reservoir is less than about 1200 meters in depth; wherein the heavy oil reservoir is comprised of heavy oil and sand which is unconsolidated at temperatures at which the heavy oil is mobilizable; wherein the heavy oil reservoir is substantially impermeable at reservoir temperatures; wherein the reservoir is first horizontally hydraulically fractured from the production well; wherein steam is injected into the production well to float the fracture and impart heat to it; and wherein the formation is horizontally hydraulically fractured from the injection well, establishing fluid communication with the production well prior to step (b); and wherein water employed to make steam for injection is preheated by passing in heat exchange relationship with hot fluids produced from the production well.

7. The process of claim 2 wherein matrix flow steam flooding is subsequently effected from the injection well to the production well and heavy oil is recovered from the production well.

8. The process of claim 2 wherein a thinning agent for the produced heavy oil is injected to the production horizon of the production well and there admixed with the produced heavy oil to prevent plugging of the production well by congealing of the heavy oil.

9. The process of claim 2 wherein water employed to make steam for injection is preheated by passing in heat exchange relationship with hot fluids produced from the production well.

10. The process of claim 2 wherein the reservoir has a thickness of about 3 to 10 meters, is about 20 to 200 meters in depth, and contains a heavy oil having an API gravity of about 20 to about −2.

11. The process of claim 2 wherein back pressure is held on the production well as needed when injecting steam into the injection well in step (b) to insure float of the formation between the injection well and the production well.

12. The process of claim 2 wherein a plurality of injection wells and a plurality of production wells are employed in a pattern configuration in which at least two production wells are provided for each injection well.

13. The process of claim 2 wherein a center injection well and a plurality of production wells are employed in an inverted five-spot, inverted seven-spot, or inverted nine-spot configuration.

14. The process of claim 2 wherein the reservoir is hydraulically fractured between the wells in step (a) by first horizontally hydraulically fracturing the reservoir from the production well with an aqueous liquid and then horizontally hydraulically fracturing the reservoir with an aqueous liquid from the injection well into fluid communication with the fracture from the production well.

15. The process of claim 14 wherein A is the area to be substantially heated between the wells expressed in square meters; wherein h is the thickness of the reservoir to be substantially heated expressed in meters; and wherein $TE_{RH}$ is a rational positive number in the range of 0.7 to 0.9.

16. A process for establishing a zone of heated heavy oil having mobility and horizontally traversing a heavy oil reservoir comprising sequentially:

(a) penetrating the reservoir with an injection well bore and a production well bore horizontally separated from each other;
(b) fracturing from the production well;
(c) injecting a hot aqueous fluid at a temperature above 100° C. into the production well to part the fracture zone and impart heat to it;
(d) hydraulically fracturing from the injection well into fluid communication with the production well;
(e) injecting a hot aqueous fluid at a temperature above 100° C. into the injection well at a very high rate and a pressure sufficient to part the formation along the fracture system between the wells while producing fluids from the production well such as to effect channel flow of liquids through the parted fracture system between the wells and to form a heated permeable zone of mobilizable heavy oil in the formation in proximity to the fracture system between the wells;

wherein the fractures between the production wells and the injection well are formed by horizontal hydraulic fracturing, wherein the heavy oil reservoir is less than about 1500 meters in depth, and wherein subsequent to step (e), heavy oil is recovered as the heated permeable zone of mobilizable heavy oil between the wells is enlarged by effecting channel flow conduction heating steam flooding.

17. The process of claim 16 wherein the hot aqueous fluid comprises steam, wherein the channel flow conduction heating steam flooding step is followed by sweeping substantial of the reservoir between the wells with a drive front of matrix flow steam, combustion, water modified combustion, oxygen-enhanced steam, caustic enhanced hot water, or water.

18. The process of claim 17 wherein back pressure is held on the production well if needed in step (e) to insure float of the formation between the injection well and the production well.

19. The process of claim 17 wherein the reservoir is depressured at the production well subsequent to injection of steam in step (c) by producing fluids therefrom.

20. The process of claim 17 wherein a plurality of injection wells and a plurality of production wells are employed in a line drive configuration.

21. The process of claim 17 wherein a center injection well and a plurality of production wells are employed in a pattern configuration and wherein at least two production wells are provided for each injection well.

22. The process of claim 21 wherein the heavy oil reservoir is less than 600 meters in depth, is comprised of heavy oil and sand is unconsolidated at temperatures at which the heavy oil is mobilizable, is substantially impermeable at reservoir temperatures, in which the heavy oil has an API gravity of 10 or less, in which the heavy oil is substantially reduced in viscosity by heating, wherein the hydraulic fractures are initiated by notching into the formation from the initiating well, wherein an aqueous fluid is employed as a hydraulic fracturing agent, wherein charge water employed to make steam is preheated in heat exchange relationship with hot fluids produced from the production well, wherein a solvent or thinning agent is injected into the production well and there admixed with produced heavy oil at the production horizon to prevent plugging of the production wells, and wherein the production well is allowed to produce down to reservoir pressure prior to step (d).

23. A process for producing a tar having an API gravity of less than 10 from an unconsolidated tar sand formation of less than about 1500 meters in depth wherein the tar sand formation is substantially impermeable to fluids at reservoir temperature comprising sequentially:

(a) penetrating the tar sand formation with an injection well bore and a production well bore horizontally separated from each other;
(b) horizontally hydraulically fracturing from the production well;
(c) injecting a hot aqueous fluid at a temperature above 100° C. into the production well to float the fracture zone and impart heat to it;
(d) horizontally hydraulically fracturing from the injection well into fluid communication with the production well;
(e) injecting a hot aqueous fluid at a temperature above 100° C. into the injection well at a very high rate and a pressure sufficient to float the formation along the fracture system between the wells while producing fluids from the production well such as to effect channel flow of fluids through the parted fracture system between the wells and to thus form a heated zone of mobilizable tar in the formation in proximity to the fracture system between the wells; and
(f) passing a hot aqueous fluid at a temperature above 100° C. into the injection well and fluids through the heated permeable channel between the wells to effect conduction heating steam flooding therebetween with tar recovery from the production well.

24. The process of claim 22 wherein the aqueous fluid is steam, wherein step (f) of claim 22 is followed by sweeping substantial of the reservoir between the wells with a matrix flow drive front of steam, combustion, water modified combustion, oxygen enhanced steam, caustic enhanced hot water, or water.

25. The process of claim 24 wherein the reservoir between the wells is swept with a drive front of steam by matrix flow.

26. The process of claim 25 wherein back pressure is held on the production well as needed in step (e) to insure float of the formation between the injection well and the production well and wherein a center injection well and a plurality of production wells are employed in an inverted five-spot or nine-spot configuration.

27. The process of claim 26 wherein the production well is allowed to produce down to near reservoir pressure prior to step (d).

28. The process of claim 23 wherein the hot aqueous fluid is preheated in heat exchange relationship with hot fluids produced from the production well.

29. The process of claim 23 wherein a solvent or thinning agent is injected into the production well and there admixed with produced oil to prevent plugging of the production well.

30. In a process for establishing a zone of increased heat and fluid mobility between an injection well and a production well vertically penetrating a heavy oil reservoir comprising:

(a) first hydraulically fracturing between the wells, (b) thereupon injecting a hot aqueous fluid at a temperature above 100° C. into the injection well, and (c) producing fluids from the production well;

the improvement comprising:

injecting the hot aqueous fluid at a rate "$Q_H$" expressed in J/Day which is equal to $5.04\times10^7$ A/h exp $(0.02739\times TE_{RH})$; wherein A is the reservoir area to be substantially heated expressed in square meters; wherein h is the thickness of the reservoir to be substantially heated expressed in meters; and wherein $TE_{RH}$ is a positive rational number in the range of 0.4 to 1.0.

31. The process of claim 30 wherein $TE_{RH}$ is a positive rational number in the range of 0.7 to 1.0 and the hot aqueous fluid is steam.

32. A process for establishing a zone of increased heat and fluid mobility between an injection well and a production well vertically penetrating a heavy oil reservoir comprising:

(a) first hydraulically fracturing between the wells, (b) thereupon injecting a heated aqueous fluid at a temperature above 100° C. into the injection well, and (c) producing fluids from the production well;

characterized by: injection of the heated aqueous fluid at a sufficiently high rate, at a sufficient pressure, and for a sufficient time to maintain parting of the formation along the fracture system between the wells to effect channel flow of liquids through the parted fracture system, and to effect conduction heating of substantial reservoir volume perpendicular to the channel flow; wherein the heated aqueous fluid is injected at a rate "$Q_f$" which is equal to $Q_s/SG_fH_f1/1.812\times10^6$ A/h exp $(0.02739\times TE_{RH})$, wherein $H_f$ is the bottomhole enthalpy of the heated aqueous fluid expressed in Btu per pound, wherein $SG_f$ is the ambient temperature specific gravity of the heated aqueous fluid, wherein a barrel of steam is defined to have a bottomhole enthalpy of 1000 Btu per pound, wherein A is the horizontal area to be heated between the wells expressed in acres, wherein h is the thickness of the reservoir to be substantially heated expressed in feet, and wherein $TE_{RH}$ is a positive rational number in the range of 0.4 to 1.0.

* * * * *

UNITED STATES PATENT AND TRADEMARK OFFICE

CERTIFICATE OF CORRECTION

PATENT NO. : 4,265,310

DATED : May 5, 1981

INVENTOR(S) : Inventors-Michael W. Britton et al

It is certified that error appears in the above-identified patent and that said Letters Patent are hereby corrected as shown below:

Column 5, line 35, "X2" should be "$X^2$".

Column 10, line 12, the words "after steam" should be inserted after the word "time".
Column 11, line 55, the word "stem" should be "steam".
Column 12, line 54, the word "injection" should be "injecting".
Column 13, line 14, the formula "$Q_s$" $\geqq$ 0.2174" should read ""$Q_s$" $\geqq$ 0.02174".
Column 17, line 48, the word "pressures" should be "pressure".
Column 18, line 63, the formula "(0.59$m^3$/min." should be "(0.59$m^3$/min.)".
Column 19, line 30, the word "preforated" should be "perforated".
Column 19, line 37, the word "termocouple" should be "thermocouple".
Column 19, line 44, the formula "$M^3$" should be "$m^3$".
Column 19, line 45, the word "guage" should read "gauge".
Column 20, line 3, the word "matric" should read "metric".
Column 23, line 29, the word "injecting" should be "injection".
Column 24, Claim 7, reads "The process of claim 2" and should be "The process of claim 1".
Column 24, Claim 8, reads "The process of claim 2" and should be "The process of claim 1".
Column 24, Claim 9, reads "The process of claim 2" and should be "The process of claim 1".

UNITED STATES PATENT AND TRADEMARK OFFICE

CERTIFICATE OF CORRECTION

PATENT NO. : 4,265,310

DATED : May 5, 1981

INVENTOR(S) : Michael W. Britton et al

It is certified that error appears in the above-identified patent and that said Letters Patent are hereby corrected as shown below:

Column 24, Claim 10, reads "The process of claim 2" and should be "The process of claim 1".

Column 24, Claim 11, reads "The process of claim 2" and should be "The process of claim 1".

Column 25, Claim 12, reads "The process of claim 2" and should be "The process of claim 1".

Column 25, Claim 14, reads "The process of claim 2" and should be "The process of claim 1".

Column 25, line 49, the word "wells" should be "well".

Column 26, line 9, the word "two" should be "one".

Column 26, line 10, the words "wells are" should be "well is".

Column 26, Claim 24, reads "The process of claim 22" and should read "The process of claim 23".

Column 26, line 64, reads "of claim 22" and should read "of claim 23".

---

Column 23, line 61, reads "in the range of 0.4 to 1.0" and should read "in the range of 40 to 100".

Column 23, line 63, reads "in the range of 0.7 to 0.9" and should read "in the range of 70 to 90".

Column 24, line 24, reads" in the range of 0.7 to 0.9" and should read "in the range of 70 to 90".

UNITED STATES PATENT AND TRADEMARK OFFICE

CERTIFICATE OF CORRECTION

PATENT NO. : 4,265,310

DATED : May 5, 1981

INVENTOR(S) : Michael W. Britton et al

It is certified that error appears in the above-identified patent and that said Letters Patent are hereby corrected as shown below:

Column 25, line 25, reads "of 0.7 to 0.9" and should read "of 70 to 90".

Column 28, line 2, reads "range of 0.4 to 1.0" and should read "range of 40 to 100".

Column 28, line 4, reads "in the range of 0.7 to 1.0" and should read "in the range of 70 to 100".

Signed and Sealed this

*Twentieth* Day of *April 1982*

[SEAL]

*Attest:*

GERALD J. MOSSINGHOFF

*Attesting Officer* *Commissioner of Patents and Trademarks*